US011530547B2

(12) United States Patent
McUtchen

(10) Patent No.: US 11,530,547 B2
(45) Date of Patent: Dec. 20, 2022

(54) BUILDING STRUCTURE

(71) Applicant: PARKD LTD, Claremont (AU)

(72) Inventor: Peter James Stirling McUtchen, Cottesloe (AU)

(73) Assignee: PARKD LTD, Claremont (AU)

( * ) Notice: Subject to any disclaimer, the term of this patent is extended or adjusted under 35 U.S.C. 154(b) by 269 days.

(21) Appl. No.: 16/487,521

(22) PCT Filed: Feb. 26, 2018

(86) PCT No.: PCT/AU2018/050164
§ 371 (c)(1),
(2) Date: Aug. 21, 2019

(87) PCT Pub. No.: WO2018/152590
PCT Pub. Date: Aug. 30, 2018

(65) Prior Publication Data

US 2020/0056393 A1 Feb. 20, 2020

(30) Foreign Application Priority Data

Feb. 24, 2017 (AU) ..... 2017900630

(51) Int. Cl.
*E04H 6/10* (2006.01)
*E04C 5/08* (2006.01)
(Continued)

(52) U.S. Cl.
CPC ..... *E04H 6/10* (2013.01); *E04B 5/043* (2013.01); *E04B 5/046* (2013.01); *E04B 5/265* (2013.01); *E04C 5/08* (2013.01)

(58) Field of Classification Search
CPC . E04H 6/10; E04B 5/043; E04B 5/046; E04B 5/265; E04C 5/08
(Continued)

(56) References Cited

U.S. PATENT DOCUMENTS 667,871 A * 2/1901 Ellinger ..... E04C 3/04 52/223.11
2,008,087 A * 7/1935 Stromberg ..... E04B 1/2403 403/189
(Continued)

FOREIGN PATENT DOCUMENTS

| | | |
|---|---|---|
| AU | 2014203324 A1 | 3/2015 |
| EP | 2738322 A1 | 6/2014 |
| GB | 2478739 A | 9/2011 |

OTHER PUBLICATIONS

International Search Report and Written Opinion dated May 25, 2018 from International Application No. PCT/AU2018/050164 (Authorised officer, Conor O'Brien), 13 pages.

*Primary Examiner* — Phi D A
(74) *Attorney, Agent, or Firm* — MH2 Technology Law Group, LLP

(57) ABSTRACT

The invention relates to a lightweight concrete building structure using pre-stressed lightweight structural beams 46 with a lightweight floor panel (48) spanning between beams (46). In a particular arrangement, the parking system using building structure (10) may be about less than half the weight than traditional parking building structures. In accordance with one arrangement of the particular embodiment of the invention, the building structure comprises floor structures having one or more structural beams, and one of more lightweight panels for attachment to the structural beam, wherein the floor structure is defined by joining together the one or more lightweight structural beams and the one of more lightweight panels. This particular arrangement is particularly useful because it permits defining a floor structure capable of sustaining relative large loads (such as a multitude of vehicles) using lightweight floor panels.

38 Claims, 16 Drawing Sheets

(51) Int. Cl.
*E04B 5/04* (2006.01)
*E04B 5/26* (2006.01)

(58) Field of Classification Search
USPC .... 52/175, 185, 223.8, 223.11, 236.3, 236.7, 52/236.8, 480, 649.2, 650.1, 650.2, 650.3, 52/660
See application file for complete search history.

(56) References Cited

U.S. PATENT DOCUMENTS 3,971,179 A * 7/1976 Bodocsi ..... E04B 1/24 52/223.11
4,564,311 A * 1/1986 Scales ..... E02B 3/14 404/35
4,644,727 A 2/1987 Hanson et al.
4,972,537 A * 11/1990 Slaw, Sr. ..... E01D 19/125 14/73
5,373,675 A * 12/1994 Ellison, Jr. ..... E04B 5/10 52/320
5,671,573 A * 9/1997 Tadros ..... B28B 7/0029 52/223.8
5,704,181 A * 1/1998 Fisher ..... E04B 1/24 52/338
5,720,135 A * 2/1998 Paquette ..... E04H 6/10 52/174
5,941,482 A * 8/1999 Santagata ..... E01B 7/24 246/428
6,454,232 B1 * 9/2002 Roth ..... F16B 2/065 248/226.11
6,751,821 B1 * 6/2004 Han ..... E01D 2/02 14/74.5
6,959,898 B1 * 11/2005 Laughlin ..... F16L 3/26 248/58
8,720,154 B1 * 5/2014 Horne ..... E04B 7/045 52/653.1
8,919,072 B2 * 12/2014 Han ..... E04B 1/34 52/699
9,487,964 B1 * 11/2016 Mayo ..... E04H 6/12
9,803,380 B2 * 10/2017 Simmons ..... E04G 5/14
10,253,492 B2 * 4/2019 Uno ..... E04B 1/24
2004/0050013 A1 * 3/2004 Okada ..... E04C 3/32 52/848
2005/0055969 A1 * 3/2005 Simmons ..... E04C 3/04 52/831
2006/0272267 A1 * 12/2006 Mentado-Duran ..... E04C 3/26 52/693
2008/0053014 A1 * 3/2008 Hovey ..... E04B 1/24 52/223.11
2009/0064610 A1 * 3/2009 Ahn ..... E04C 3/26 52/223.11
2011/0047920 A1 * 3/2011 Garrett ..... E04B 5/48 52/565
2012/0079782 A1 * 4/2012 Kim ..... E04B 5/29 52/220.1
2013/0168041 A1 * 7/2013 Teron ..... F24D 11/0214 165/49
2015/0040496 A1 2/2015 Holzberger
2016/0123501 A1 5/2016 Francies, III
2016/0319541 A1 * 11/2016 Sanabra ..... E04B 5/48

* cited by examiner

Detail B

Detail D

Detail K

Detail E

Detail F

Detail G

Detail K

Detail C

Detail J

BUILDING STRUCTURE

CROSS-REFERENCE TO RELATED APPLICATIONS

This application is a U.S. National Stage application of PCT/AU2018/050164 filed 26 Feb. 2018, which claims priority to Australian Application No. 2017900630 filed 24 Feb. 2017, the entire disclosures of which are hereby incorporated by reference in their entireties.

TECHNICAL FIELD

The present invention relates to building structures and methods for erecting the building structures.

The invention has been devised particularly, although not necessarily solely, in relation to permanent and temporary building structures for parking facilities.

BACKGROUND ART

The following discussion of the background art is intended to facilitate an understanding of the present invention only. The discussion is not an acknowledgement or admission that any of the material referred to is or was part of the common general knowledge as at the priority date of the application.

Parking in most cities of the world is an ever increasing issue. In large cities the parking pressure is relative great due to (1) the great amount of people using vehicles for entering the cities for doing business and after close of business for returning home; and (2) typically, in great cities there are not enough parking solutions due to, for example, the high costs of lots of land that are available for erecting building structures.

On occasions, lots of lands inside cities have been cleared due to, for example, demolition of a damaged building structure. These lots after the demolition process remain idle for relative long periods of time until construction of a new building structure 10 commences.

Idle lands in cities may be, at least temporarily, leased out for particular uses such as single-story parking facilities. However, the existence of a relative small quantity of parking bays on several idle lots of land does not provide enough parking bays for easing parking pressures in a city. And, erecting temporary multi-story parking facilities on an idle lot of land is currently relatively costly. This is particularly true due to the relative high costs involved in erecting multi-story building structures.

Further, in some major Australian cities parking costs in hot spots inside the city has almost become uncontrollable. Costs in Sydney have hit $59 per hour for casual parking and averages in the city centers of over $40 per hour. Australia is not alone with parking issues, many global cities have pressures in hot spots and when large projects are underway on active sites.

Moreover, governments across the world are trying to encourage the use of high performance public transport, but often the car remains the transport of choice. In fact, city councils and regulators wish to discourage car usage, but people love to drive to work and have the convenience of their car; this is particularly true due to the fact that, for example, public transport does not provide transportation directly to the house or to the place of work; also public transportation is available only at certain times.

To encourage the use of public transport such as train services, public transportation services have been developing parking solutions adjacent train stations; for commuters to drive from their homes to the train station and vice versa to use the train services.

To provide these parking solutions adjacent the train stations, lots of land close to train stations are being cleared for providing parking bays to users of the train services. This allows commuters to drive to the train stations and park their vehicles so they may use the train services to commute between the particular train station and, for example, their workplace located in the city.

However, due to the relative high costs involved for erecting multi-story parking facilities, the parking facilities located adjacent the train stations are not multi-story building structures. Instead, typically the parking facilities at train stations comprise exclusively a plurality of parking bays defined on the ground of the lot of land disposed as a parking facility. Thus, currently these parking facilities offer a relative low quantity of parking bays when compared to the relative large quantity of commuters that would need to park their vehicles at these parking facilities to use the train services and avoid driving into the city with their vehicles and park the vehicles in parking facilities located inside the city at a relative high cost.

Moreover, in conventional building structures (for example, the ones that are typically used as parking facilities and thus capable of sustaining relative large loads) the floor structures may be defined by floor panels consisting of a plurality of hollow core planks joined together to create a slab structure. In these conventional building structures: (1) the hollow core planks are not designed for sustaining relative large loads but act as the secondary support structure typically defining the floor panels and (2) the floor panels act as the primary support structure due to being adapted to sustain relative large loads by pouring a concrete topping on top of the hollow core planks creating a composite structure that cannot be reused or adapted without demolition. Therefore, currently assembly and disassembly of the conventional building structures is cumbersome and time consuming.

It is against this background that the present invention has been developed.

SUMMARY OF INVENTION

In accordance with a particular embodiment of the invention, there is provided a multi-story, modularised concrete parking structure that can be installed easily, be made operational in a relative short period of time and demobilised quickly and easily relocated to a new location if required.

In accordance with one arrangement of the particular embodiment of the invention there is provided a floor structure comprising one or more structural beams, and one of more lightweight panels for attachment to the structural beam(s), wherein the floor structure is defined by joining together the one or more structural beams and the one of more lightweight panels. This particular arrangement is particularly useful because it permits defining a floor structure capable of sustaining relative large loads (such as a multitude of vehicles) using lightweight panels. The reason that floor structure capable of sustaining relative large loads is that lightweight panels are joined together via structural beam(s) to define the floor structure.

Preferably, one or more structural beams comprises one or more beams in accordance with the present embodiment of the invention.

According to a first aspect of the invention there is provided a beam for defining a floor structure, the beam comprising a body having upper and lower faces and first and second sides, the upper and lower faces being spaced apart from each other a particular distance defining the depth of the beam, and a plurality of passages extending longitudinally along the beam, the plurality of passages being arranged in a spaced apart relationship with respect to each other defining a plurality of first webs between neighboring passages and a pair of second webs between the first and second sides of the beam and the outermost passages, the first web having a width that is equal to the distance between neighboring passages and the second webs having a width that is equal to the distance between the first and second sides of the beam and the outermost passages, wherein the summation of the widths of the first webs and the second webs is greater or equal to the depth of the beam.

Preferably, the passages comprises voided passages.

Preferably, a plurality of group of strands are arranged in a spaced apart relationship with respect to each other and extending longitudinally along the beam.

Preferably, the beam comprises a first group of support cables adjacent the upper face of the beam, a second group of sets of second strands located adjacent the lower face of the beam, and a third group of two pairs of third strands, each pair located at one lower corner of the beam.

Preferably, the beam comprises five support cables located at an upper section of the beam arranged in a spaced apart relationship with respect to each other and extending from one side of the beam to the other side of the beam.

Preferably, a second group of second strands comprises three sets of second strands, each set of second strands comprising five second strands arranged in a trapezoidal array located at a lower section of the beam, and a third group of third strands comprising two sets of three strands arranged in an L-shaped array, each set of three strands being located at one lower corner of the beam.

Preferably, each support cable comprises a bar and a wire located side by side and joined together via a plurality of clips arranged in a spaced apart relationship with respect to each other along the length of the first strand, each clip surrounding a particular section of the each first strand.

Preferably, the bar and the wire abut each other and are joined together exclusively by the clips.

Preferably, the wire comprises a strand.

Preferably, the bar comprises deformed reinforcing steel.

Preferably, each of the second and third strands comprises a plurality of wires bundled together.

Preferably, the beam further comprises a plurality of support members traversing transversally the beam and the support members being arranged in a spaced apart relationship with respect to each other along the length of the beam.

In a particular arrangement, the support beams are spaced apart up to three meters with respect to each other.

Preferably, each support member comprises a centre section and two fin plates extending from each end of the centre section wherein the center section of the support member is contained within the beam and the fin plates extend outward from each side of the beam.

Preferably each support member comprises fastening means for attachment of floor panels to each side of the beam.

In a particular arrangement, the support beams are spaced apart three meters with respect to each other.

Preferably, each side of the beam is adapted to receive a floor panel.

Preferably, the sides of the beams are configured for receiving attachment means such as support angles.

Preferably, each side of the beam comprises a plurality of support angles arranged in a spaced apart relationship with respect to each other along the beam, the support angle being adapted to define attachment means for receiving sides of the floor panel.

Preferably, ends of the beam comprise a concrete plug extending at least partially into the passages for sealing off the passages.

According to a second aspect of the invention there is provided a support cable comprising a bar and a wire, the bar and the wire located side by side and joined together via a plurality of clips arranged in a spaced apart relationship with respect to each other along the each support cable, each clip surrounding a particular section of the support cable.

Preferably, the bar and the wire abut each other and are joined together exclusively by the clips.

Preferably, the wire comprises a strand.

Preferably, the bar comprises deformed reinforcing steel.

According to a third aspect of the invention there is provided a beam for defining a floor structure, the beam comprising a body having upper and lower faces and first and second sides, the upper and lower faces being spaced apart from each other a particular distance defining the depth of the beam, and a plurality of passages extending longitudinally along the beam, the plurality of passages being arranged in a spaced apart relationship with respect to each other defining a plurality of first webs between neighboring passages and a pair of second webs between the first and second sides of the beam and the outermost passages, the beam further comprises a first group of support cables adjacent the upper face of the beam, a second group of sets of second strands located adjacent the lower face of the beam, and a third group of two pairs of third strands, each pair located at one lower corner of the beam, wherein the support cables comprise support cables in accordance with the second aspect of the invention.

Preferably, the beam comprises five support cables located at an upper section of the beam arranged in a spaced apart relationship with respect to each other and extending from one side of the beam to the other side of the beam.

Preferably, a second group of second strands comprises three sets of second strands, each set of second strands comprising five second strands arranged in a trapezoidal array located at a lower section of the beam, and a third group of third strands comprising two sets of three strands arranged in an L-shaped array, each set of three strands being located at one lower corner of the beam.

According to a fourth aspect of the invention there is provided a floor structure comprising first and second structural beams, and one first infill panel wherein the first and second beams are arranged in a spaced apart relationship with respect to each other defining a spacing for receiving the infill panel, each beam comprising an inner side adapted for attachment of each side of the infill panel and an outer side for receiving a side of another infill panel.

Preferably, the structural beam comprises first and second beams in accordance with either the first aspect of the invention or the third aspect of the invention.

Preferably, the infill panel comprises a lightweight panel.

Preferably, the lightweight panel comprises lightweight joist with raised floor systems.

Preferably, the infill panel comprises a mesh structure encased in a concrete slab.

Preferably, the infill panel comprises a perimeter channel that is punched at intervals along the length to form tabs for connecting joists extending transversally from one side of the panel to the other side of the panel and arranged in a spaced apart relationship with respect to each other extending longitudinally along the panel.

Preferably, the perimeter channel comprises lifting eyes arranged in a spaced apart relationship with respect to each other.

Preferably, the perimeter channel is adapted for attachment to the inner sides of the beams.

Preferably, the floor structure further comprises a third beam and a second infill panel, the third beam being arranged in spaced apart arrangement with the first beam defining a spacing for receiving the second infill panel, the third beam comprising an inner side adapted for attachment of one side of the second infill panel and another side of the second infill panel being adapted for attachment to the outer side of the first beam.

Preferably, the floor structure further comprises a fourth beam and a third infill panel, the fourth beam being arranged in spaced apart arrangement with the second panel defining a spacing for receiving the third infill panel, the fourth beam comprising an inner side adapted for attachment of a side of the third infill panel and the other side of the third infill panel being adapted for attachment to the outer side of the second beam.

According to a fourth aspect of the invention there is provided a building structure, the building structure comprising a plurality of columns arranged in a spaced apart relationship with respect to each other, and at least one floor structure in accordance with the third aspect of the invention spaced apart from the ground and attached to the columns at a particular location along the columns.

Preferably, the building structure comprises a plurality of reinforcement beams extending between the columns.

Preferably, the building structure comprises cross bracing members extending between the columns.

Preferably, the building structure comprises outer and inner columns.

Preferably, the inner columns are spaced apart from the outer columns and bracing member extend between the inner and outer columns.

Preferably, there are a plurality of floor structures attached to the outer columns and arranged in a spaced apart relationship with respect to each other along the columns.

Preferably, the inner columns comprise a plurality of column segments extending between floor structures, ends of each column segment being attached to the floor structures between which the column segment is sandwiched.

Preferably, the column segments are spaced apart from the outer columns and bracing members extend between the outer columns and the column segments.

Preferably, the inner columns are spaced apart with respect to each other in such a manner that each pairs of bracing members joining together the outer columns and the column segments of the inner column of a particular floor structure define a portion comprising at least one parking bay.

Preferably, the building structure comprises guardrails extending between the columns.

Preferably, the building structure comprises a main area and an access area, the access area comprises staircases and ramps allowing the vehicles and pedestrians access to the main area of the building structure, wherein the ramps comprise at least one beam in accordance with the first aspect of the invention.

According to a fifth aspect of the invention there is provided a method for erecting the building structure in accordance with the fourth aspect of the invention, wherein the method comprises the step of:

a. excavation of footing and services including electrical and fire services;
b. setting up steel fixing and pouring of concrete footings;
c. transportation to site of columns and installation thereof;
d. transportation to site of beams in accordance with the first aspect of the invention and panels to define the floor structure in accordance with the third aspect of the invention and lifting thereof and attachment to each other and to the erected columns;
e. bracing each floor structure with bracing members;
f. installation of ramps together with the car deck;
g. installation of pavers on ground floor and stairs and lifts (if applicable); and
h. installation of services and parking payment installations.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENT(S)

Figure 1:
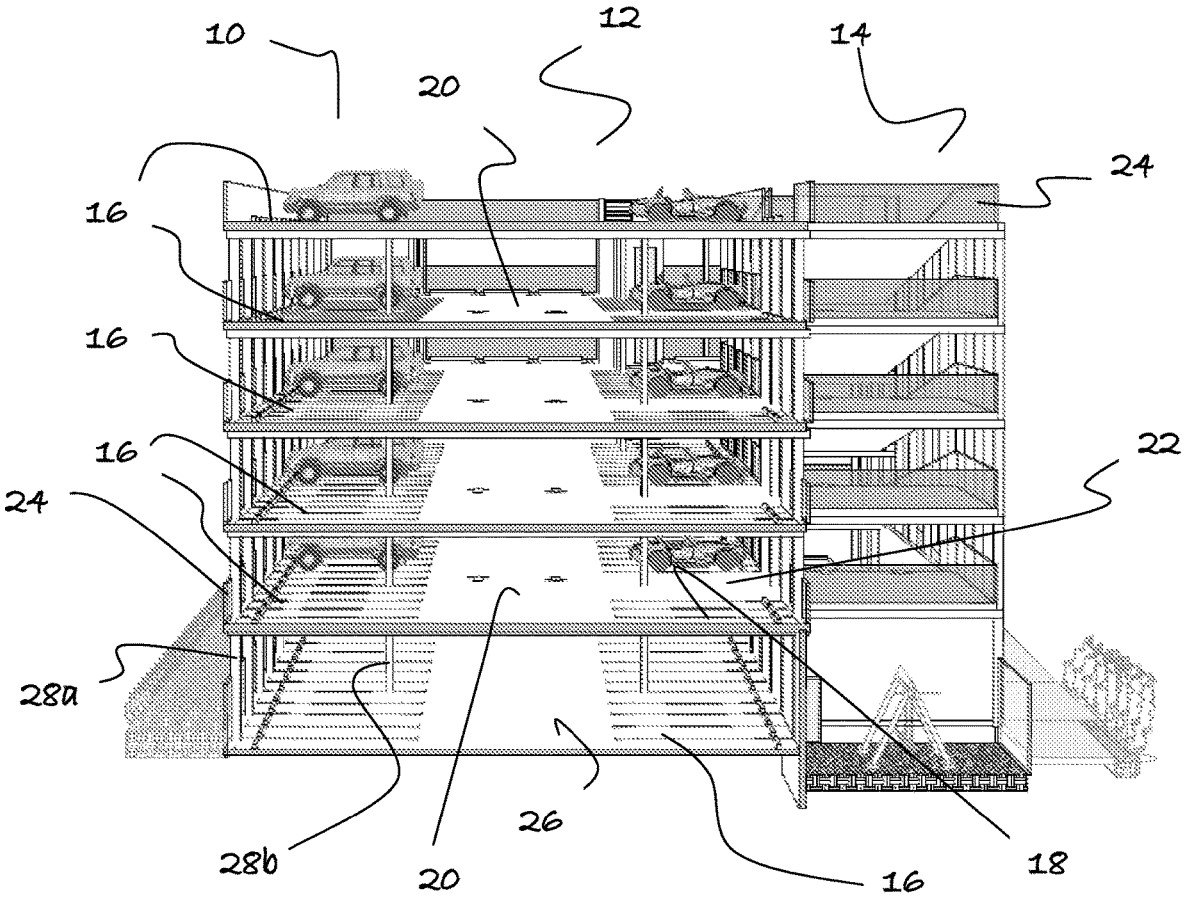
FIG. 1 is a schematic cross-sectional view of a particular arrangement of a building structure in accordance with an embodiment of the invention used as a parking structure.
Figure 2:
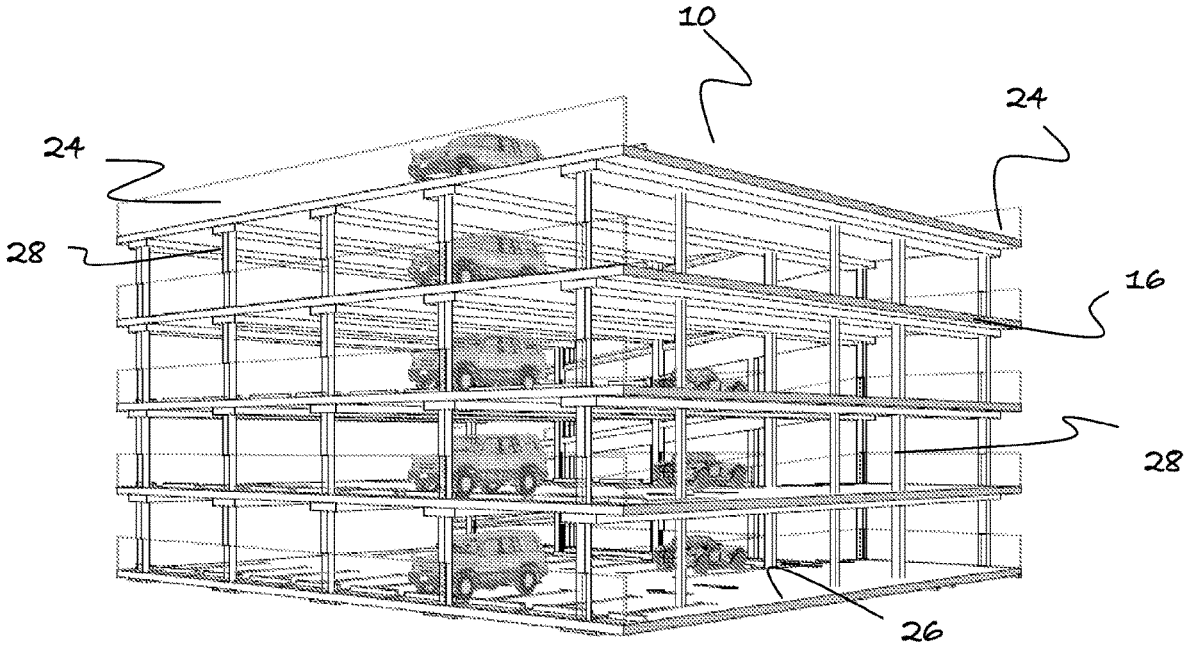
FIG. 2 is a schematic side perspective view of another particular arrangement of a building structure in accordance with the present embodiment of the invention used as a parking structure.

FIGS. 1 and 2 show a particular arrangement of a building structure 10 configured for use as a parking facility for vehicles. The building structure 10 is adapted to be selectively displaced between an assembled and disassembled condition. The fact that the building structure is adapted to be selectively displaced between an assembled and disassembled condition is particularly advantageous because it permits using the building structure as a temporary building structure 10 to be assembled on a particular lot of land for use during a particular period of time. After the building structure 10 is no longer needed or the particular lot is required for another use, the building structure 10 may be disassembled relatively fast for the lot of land be available for another use such as erection of a permanent building structure.

In accordance with the present embodiment of the invention, there is provided a parking system comprising a lightweight concrete structure using pre-stressed lightweight structural beams 46 with a lightweight floor panel 48 spanning between the beams 46. In a particular arrangement, the parking system using building structure 10 may be about less than half the weight than traditional parking building structures.

In accordance with one arrangement of the particular embodiment of the invention the building structure comprises floor structures having one or more structural beams, and one of more lightweight panels for attachment to the structural beam, wherein the floor structure is defined by joining together the one or more structural beams and the one of more lightweight panels. This particular arrangement is particularly useful because it permits defining a floor structure capable of sustaining relative large loads (such as a multitude of vehicles) using lightweight panels; the reason of this is that the lightweight panels are joined together via the one or more structural beams to define the floor structure. In an arrangement, the one or more beams are structural beams such as the beams in accordance with the present embodiment of the invention. Structural beams are designed and manufactured to sustain relative large loads such as the ones encountered in building structures and in particular in building structures used as parking facilities. This is in contrast to slabs, such as hollow core slabs, that are lightweight slabs incapable of sustaining relative large loads.

As shown in FIG. 1, the building structure 10 comprises a main area 12 and an access area 14. The access area 14 comprises staircases and ramps allowing the vehicles and pedestrians access to the main area 12 of the building structure 10.

The main area 12 comprises floor structures 16 defining the parking bays 18 for parking of the vehicles as well as aisles 20 and footpaths 22 to permit the vehicles and the pedestrians to gain access to the parking bays for parking and retrieving the vehicles. The particular arrangements shown in FIGS. 1 and 2 comprise, respectively, six and five floor structures 16.

Each of the floor structures 16 comprises guardrails 24 surrounding the floor structures 16. In the particular arrangement shown in FIGS. 1 and 2, some guardrails 24 have been removed for illustration purposes.

The building structure 10 comprises a foundation 26 mounted on the land on which the building structure 10 is erected. The foundation 26 may also be adapted to allow parking bays for vehicles.

Figure 13:
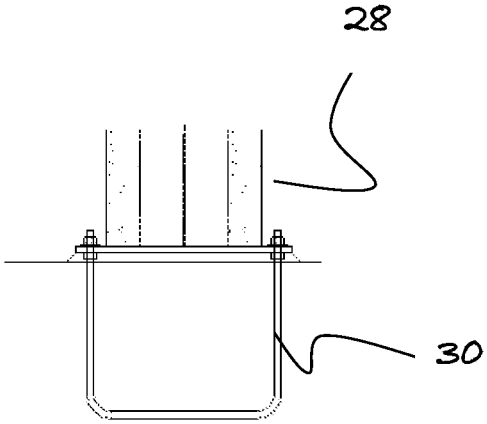
FIG. 13 is a schematic side view of a footing of the column shown in FIG. 12.

Further, a plurality of columns 28 are arranged in a spaced apart relationship with respect to each other over the foundation 26. The columns 28 comprise at their lower end footings 30 for securing the columns 28 to the ground and maintaining the columns 28 erected. FIG. 13 shows a lower end of a particular column 28 attached to a footing 30.

There are provided outer columns 28*a* and inner columns 28*b*. In the particular arrangement shown in FIGS. 3 and 4, there are provided pairs of outer and inner columns 28*a* and 28*b* arranged in a spaced apart relationship with respect to each other from one side of the building structure 10 to the other side of the building structure 10.

The columns 28 are adapted for securing each of the floor structures 16 at a particular height with respect to the ground. This permits arranging the floor structures 16 in a spaced apart relationship with respect to each other as shown for example in FIGS. 3 and 4.

Figure 12:
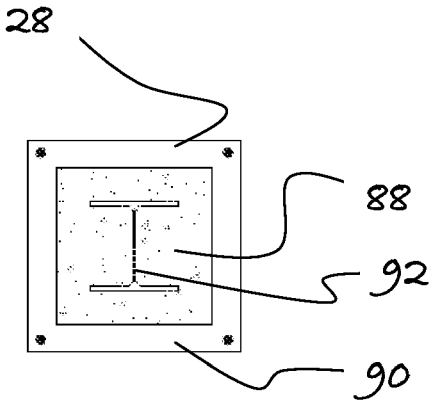
FIG. 12 is a schematic cross-sectional top view of a column of the building structure in accordance with the present embodiment of the invention.

Further, referring to FIG. 12, in a particular arrangement, the column 28 comprises an inner core 88 and an outer sleeve 90. The inner core 88 comprises an inner beam 92 (such as an I beam) embedded in casted concrete within the sleeve 90.

Figure 3:
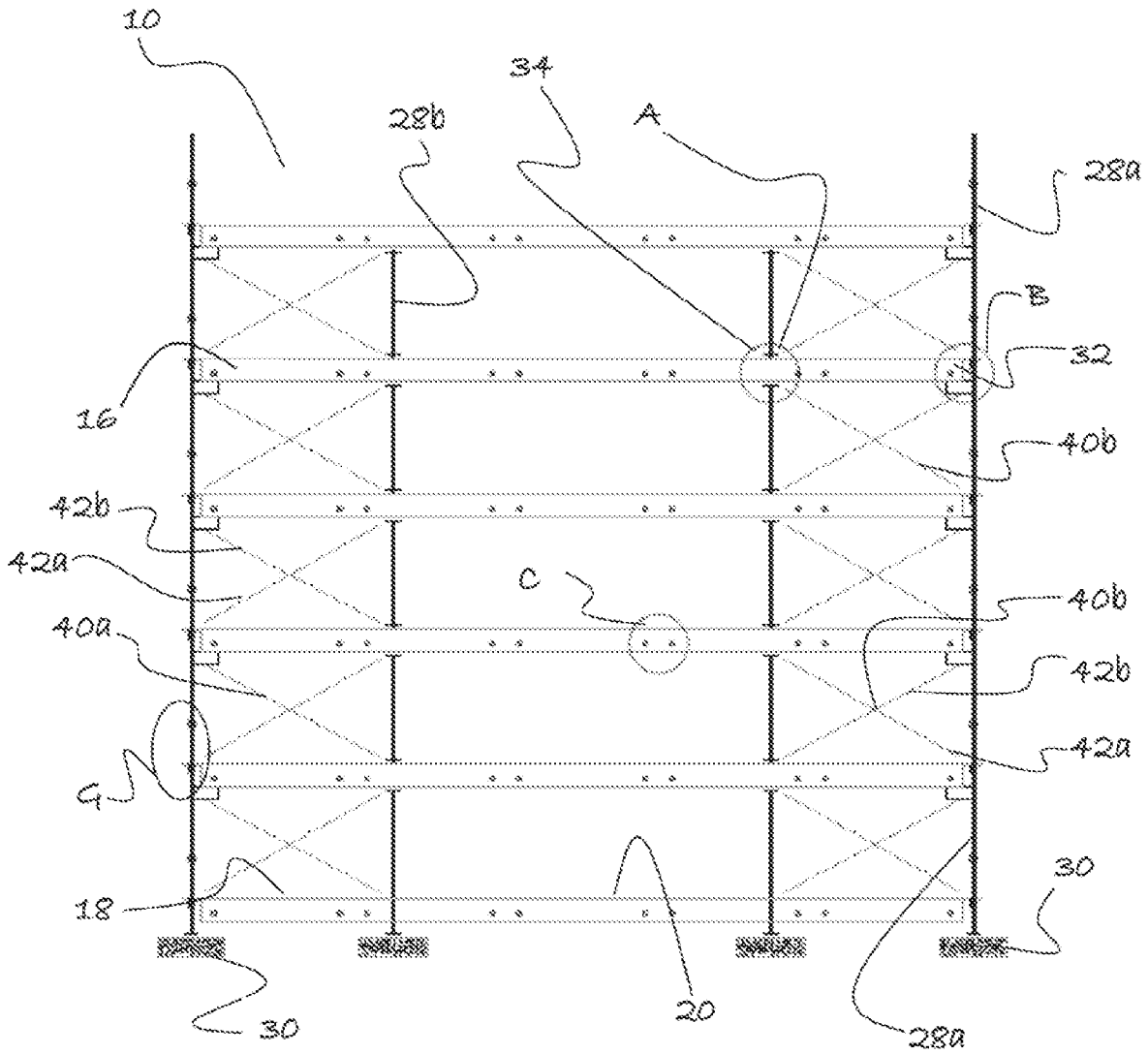
FIG. 3 is a schematic cross-sectional view of a building structure in accordance with the present embodiment of the invention.
Figure 4:
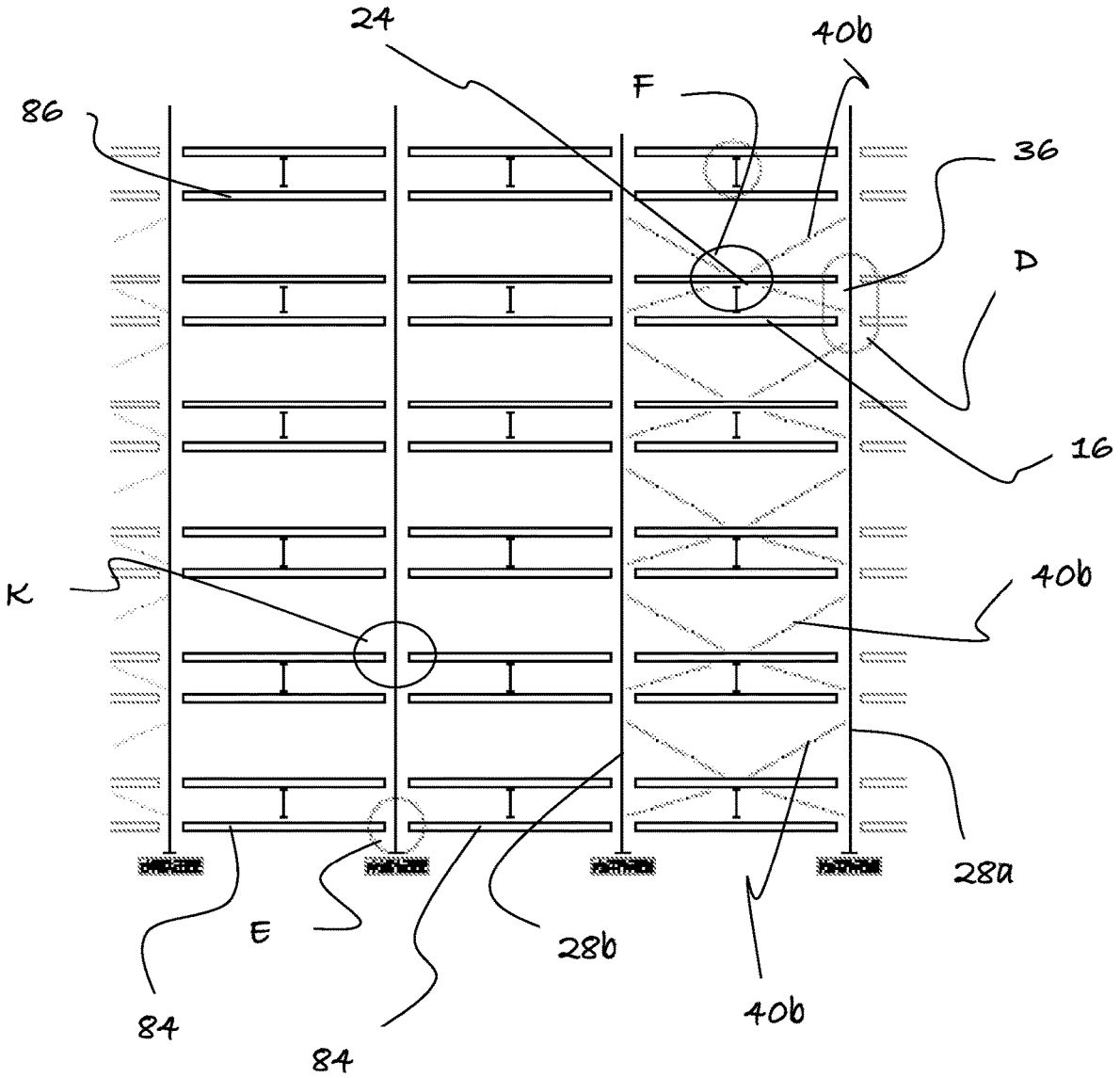
FIG. 4 is a schematic side view of the building structure in accordance with the present embodiment of the invention.

Referring now to FIGS. 3 and 4.

FIG. 3 is a schematic cross-sectional view of the building structure 10. As shown in FIG. 3 each floor structure 16 is fastened to the columns 28 at a particular location along the columns 28. Fastening of the support surface 16 to the columns 28 is accomplished via fastening means 32 and 34.

Figure 7A:
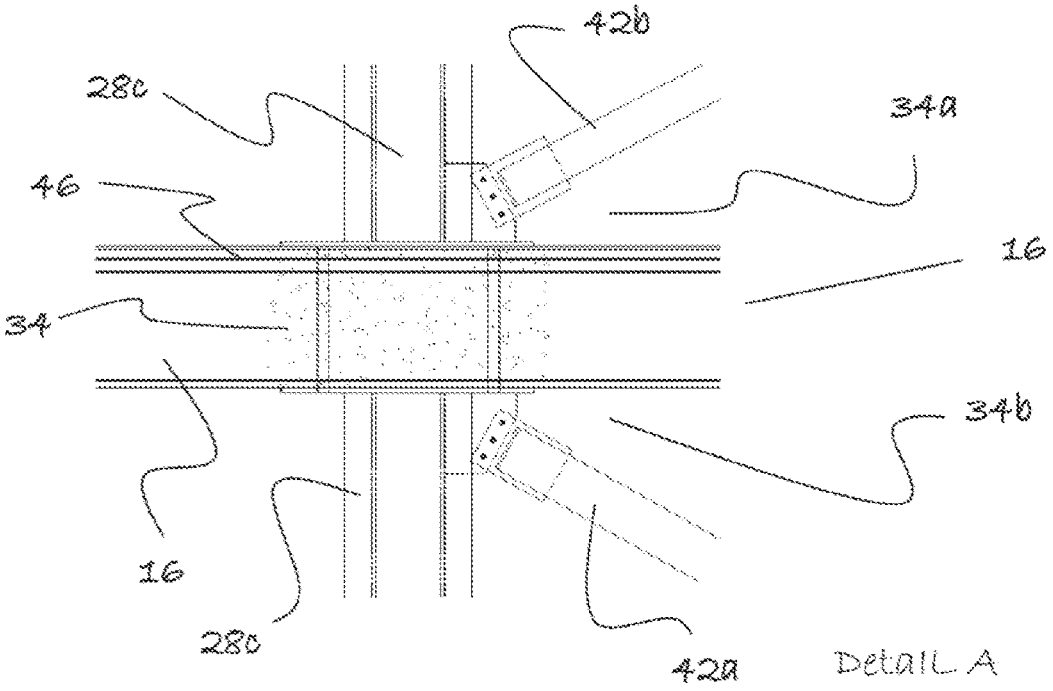
FIG. 7*a* is a schematic view of the detail A shown in FIG. 3.
Figure 7B:
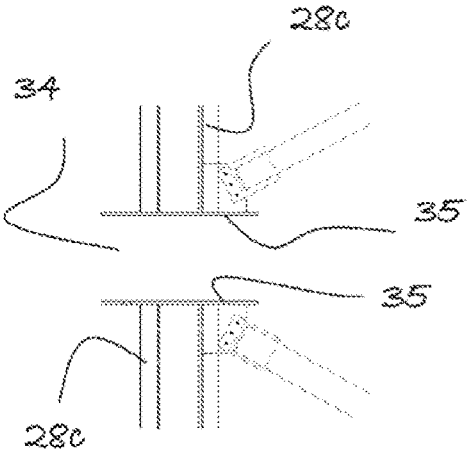
FIGS. 7*b* and 7*c* are schematic views of the detail A shown in FIG. 3 without the beam defining the floor structure.
Figure 7C:
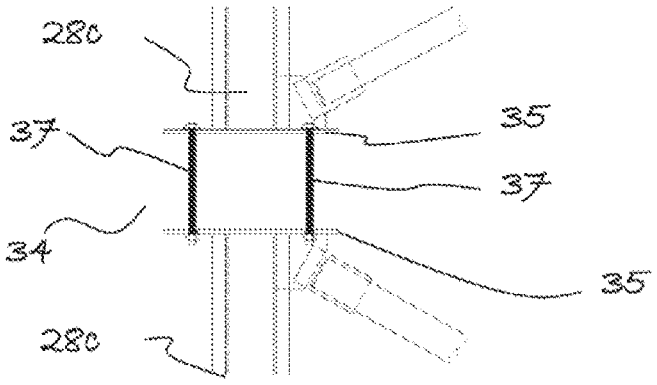
Figure 8A:
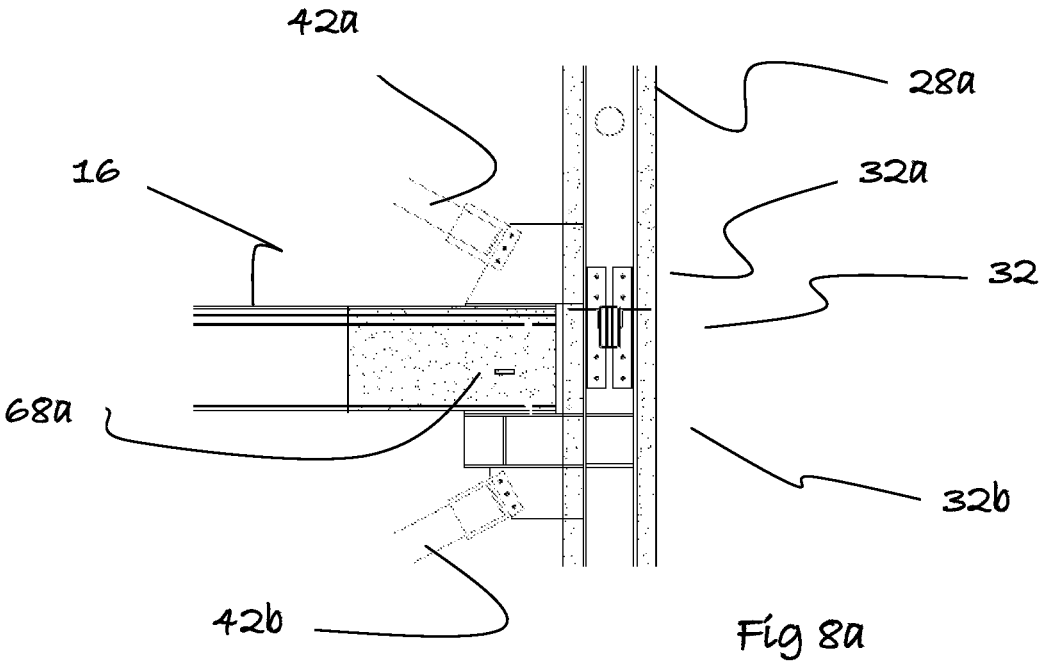
FIG. 8*a* is a schematic view of the detail B shown in FIG. 3.
Figure 8B:
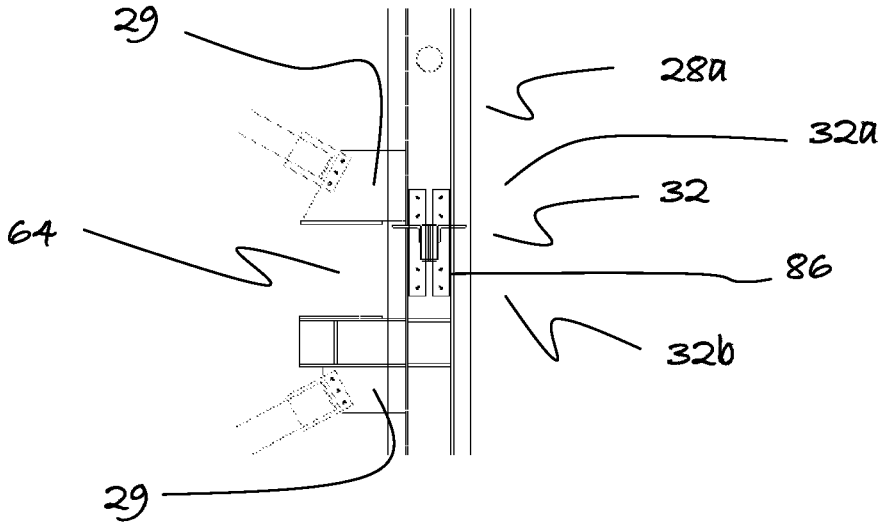
FIG. 8*b* is a schematic view of the detail B shown in FIG. 3 without the beam defining the floor structure.
Figure 9:
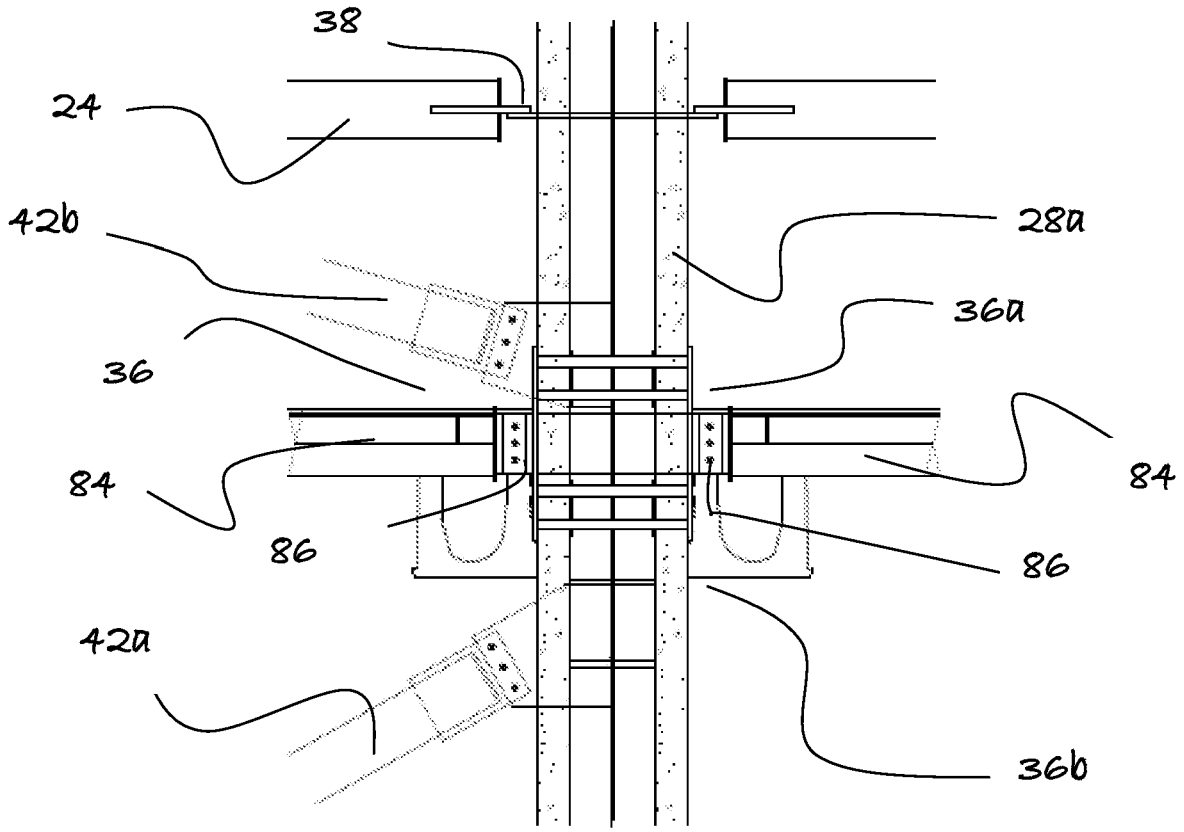
FIG. 9 is a schematic view of the detail D shown in FIG. 4.
Figure 10:
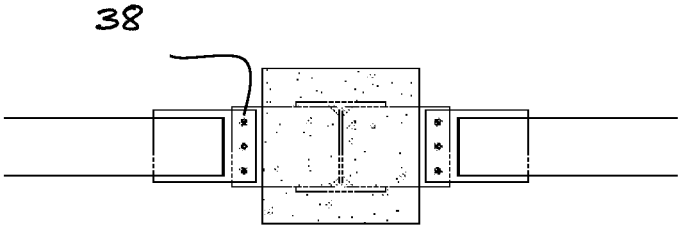
FIG. 10 is a schematic cross-sectional top view of the detail E shown in FIG. 4 showing a cross-section of a column.

The fastening means 32 are adapted for fastening the outer edges of the support surface 16 to the outmost columns 28*a*; FIGS. 8*a* and 8*b* shows the fastening means 32. The fastening means 32 comprises an upper section 32*a* and a lower section 32*b*. The fastening means 34 are adapted for fastening the inner columns 28*b* to the support surface 16; FIG. 7 shows the fastening means 34. The fastening means 34 comprises an upper section 34*a* and a lower section 34*b*.

In a particular arrangement, the inner columns 28*b* may be defined by a plurality of column segments 28*c* extending between floor structures 16. FIG. 3 shows this particular arrangement. The ends of each column segment 28*c* are attached to the floor structures 16 between which the column segment 28*c* is sandwiched. FIGS. 7*a* to 7*c* shows the attachment means 34 for fastening the lower end of a particular column segment 28*c* and the upper end of another column segment 28*c* located beneath the particular column segment 28*c*.

The attachments means 34 comprises plates 35 and bolts 37. The plates 35 are attached to the column 28*c* and surround the ends of the columns 28*c*. Attachment of the columns 28 to the floor structure 16 is done via bolts 37 traversing the plates 35 and the beams 46 that together with panels 48 define the floor structures 16.

Furthermore, the building structure 10 comprises cross-bracings members 40 for reinforcing the building structure 10.

The cross-bracing members 40 comprise support members 42 intersecting each other. In the arrangement shown in FIGS. 7*a* and 8*a*, a support member 42*a* extends from the lower section 34*b* of the fastening means 34 (see FIG. 7) to the upper section 32*a* of the fastening means 32 (see FIG. 8*a*). Another support member 42*b* extends from upper section 34*a* of the fastening means 34 (see FIG. 7) to the lower section 32*b* of another fastening means 32.

Further, the ends of the support members 42 are attached to the columns 28. As shown in, for example, FIG. 8*b*, the columns 28 comprise wings 29 being attached to the inner core 88 of the columns 28. Each wing 29 has surfaces adapted for attachment of the ends of the support members 42 of the cross-bracing members 40.

Figure 14:
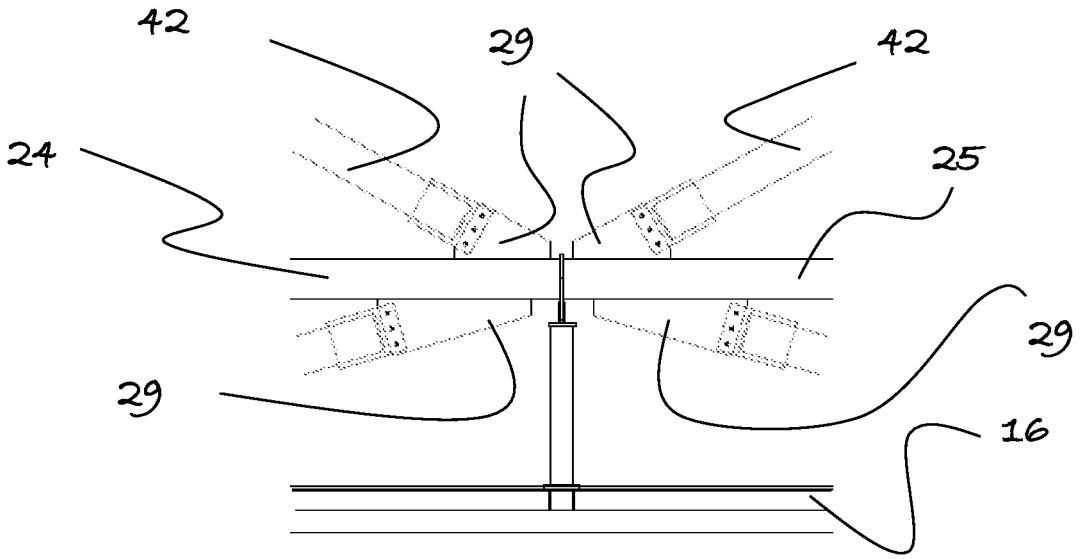
FIG. 14 is a schematic view of the detail F shown in FIG. 4.
Figure 15:
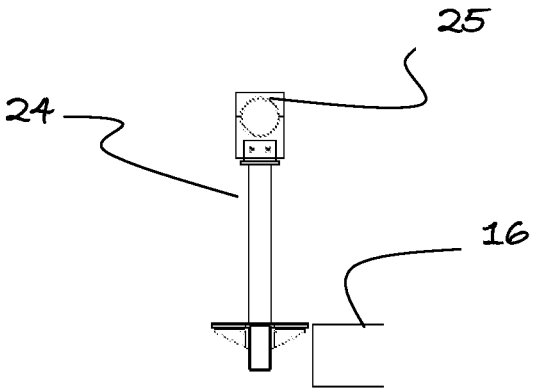
FIG. 15 is a schematic view of the detail G shown in FIG. 3.

In alternative arrangements, the bracing members 40 may be fastened to the guardrails 25. As shown in FIG. 14 the support members 42 of the bracing members may be attached to wings 29 attached to the guardrails 25 of the guardrail 24.

Referring to the particular arrangement of building structure 10 shown in FIGS. 3 and 4. As shown in FIGS. 3 and 4, each pair of columns 28*a* and 28*b* is joined together via cross-bracing members 40*a*; and a pair of neighboring columns 28*a* is joined together via cross-bracing members 40*b*. In this particular arrangement, each corner of the building structure 10 comprises two bracing members 40 arranged perpendicularly with respect to each other.

Moreover, in alternative arrangements of the building structures 10, a plurality of bracing members 40 may be disposed in other type of arrangements depending on, for example, the particular use of the building structure 10. An example of another type of bracing arrangement will be discussed below in relation to FIGS. 5 and 6; in this particular arrangement, pairs of bracing members 40 define partitions splitting the floor structure 16 into separate groups of parking bays.

Figure 11:
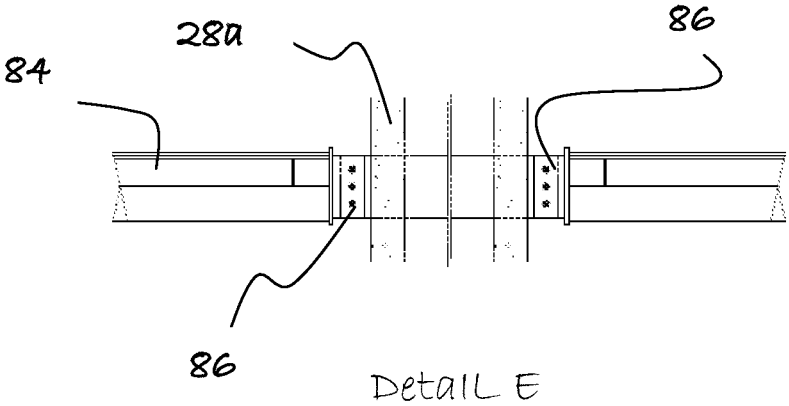
FIG. 11 is a schematic side view of the detail E shown in FIG. 4.

Moreover, as shown in FIG. 4 (for example, detail E), the building structure 10 comprises a plurality of reinforcement beams 84 extending between the columns 28*a*. For each floor structure 16 there are a plurality of reinforcement beams 84. The reinforcement beams 84 are attached to the columns 28*a* via fastening means 86—see FIGS. 8*b* and 11. Similar to the bracing members 40, the presence of the reinforcement beams 86 reinforces the building structure 10.

Figure 5:
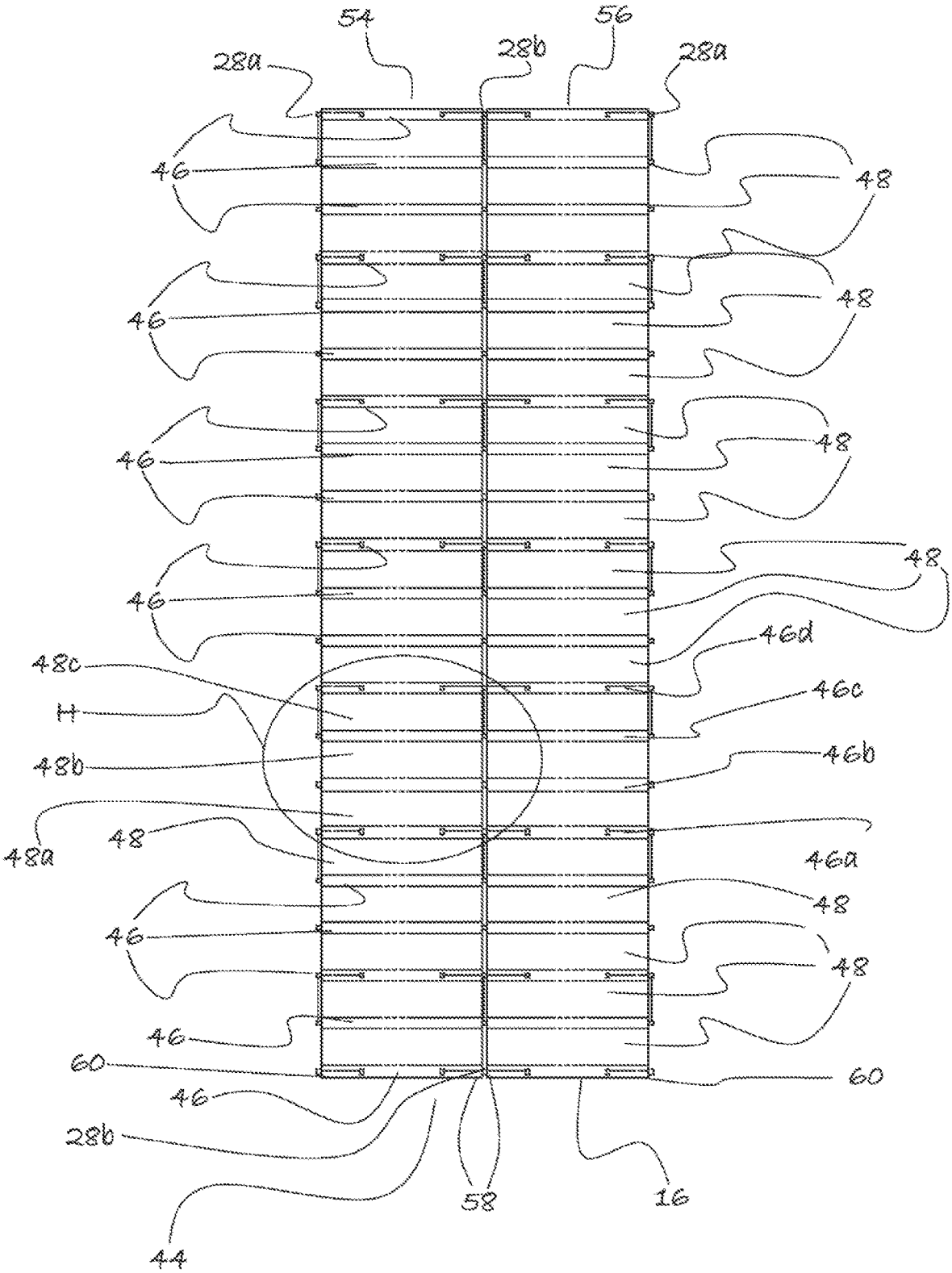
FIG. 5 is a schematic plan view of the floor structure of the building structure in accordance with the present embodiment of the invention.
Figure 6:
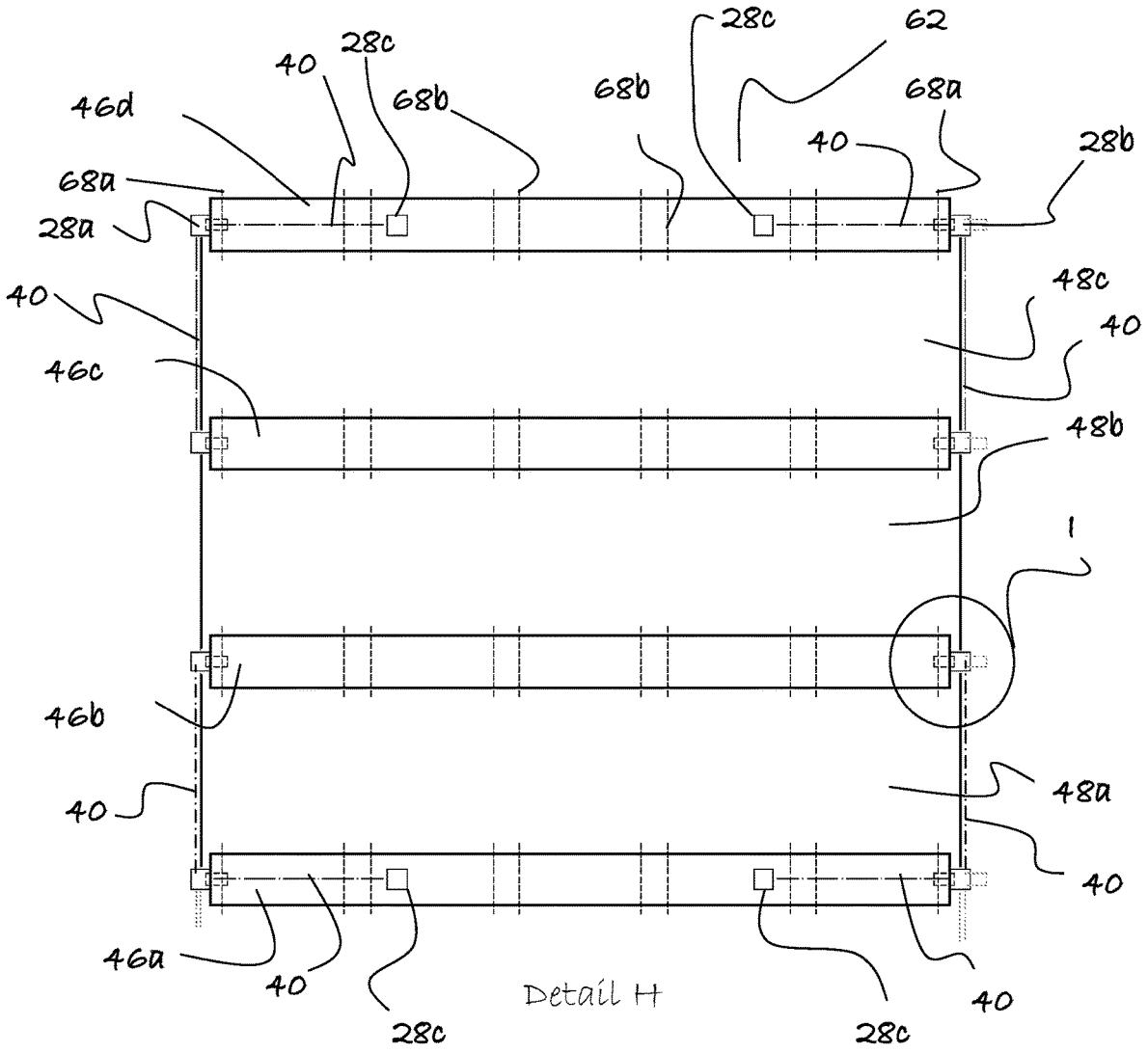
FIG. 6 is a schematic view of the detail H shown in FIG. 5.

Referring now to FIGS. 5 and 6.

FIG. 5 shows a particular arrangement of a support surface 44 for defining, for example, a floor structure 16. As mentioned before, the building structure 10 comprises plurality of floor structures 16 arranged on the top of each other and arranged in a spaced apart relationship with respect to each other defining a multi-story building structure 10. In alternative arrangements, the support surface 44 may be configured for, for example, defining the ramps that provide access to the different levels of the building structure 10.

The support surface 44 shown in FIG. 5 comprises two sections 54 and 56 located side by side. Each section 54 and 56 comprises a plurality of beams 46 in accordance with the present embodiment of the invention. The beams 46 are arranged in a spaced apart relationship with respect to each other defining a spacing for receiving panels 48 (also referred to as infill panel 48). Each beam 46 comprises sides adapted for attachment of each side of the panels 48 adjacent to each beam; in this manner, are the floor structures defined.

Panels 48 join together the beams 46 of each section 54 and 56 through support angles 66. FIGS. 16 and 19 to 21 show the support angles 66.

Any type panel may be used as an infill panel 48 such as, for example, a lightweight structure.

A particular arrangement of an infill panel 48 is shown in FIGS. 19 to 22.

The infill panels 48 comprises a mesh structure 50 encased in a concrete slab 52. The panel 48 is a lightweight panel 48 combining lightweight joist with raised floor system (RFS). A particular arrangement of the panel 48 has a thickness of 60 mm of concrete and is able to hold four vehicles.

The components of the panel 48 are manufactured using roll-forming process for dimensional accuracy. The components are punched, pressed and cut to length during the roll-forming process. Assembly of the panel 48 occurs by bolding the component together and place upside-down on a flat casting bed over reinforcement mesh.

Figure 22:
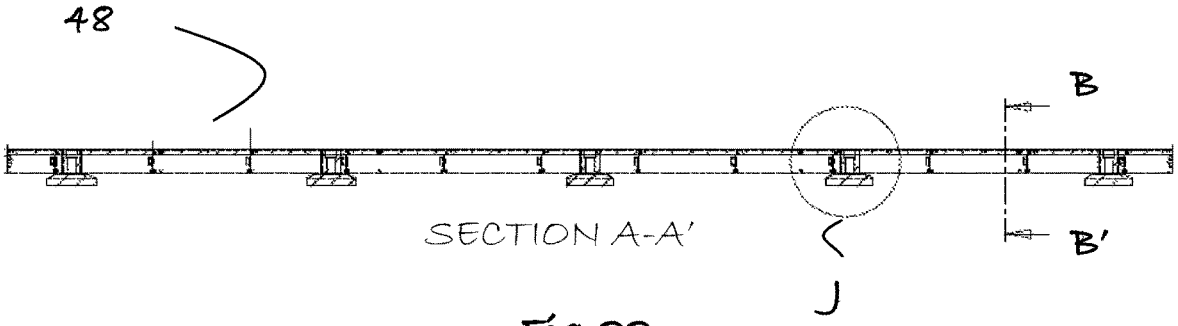
FIG. 22 is a schematic cross-sectional view of a cross-section along the line A-A' of the floor panel shown in FIG. 21.
Figure 23:
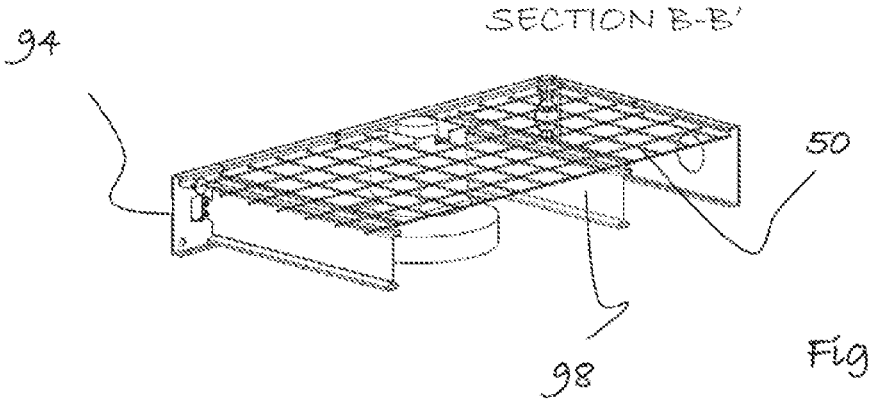
FIG. 23 is a schematic perspective view of a cross-section along the line B-B' of the floor panel shown in FIG. 22.
Figure 24:
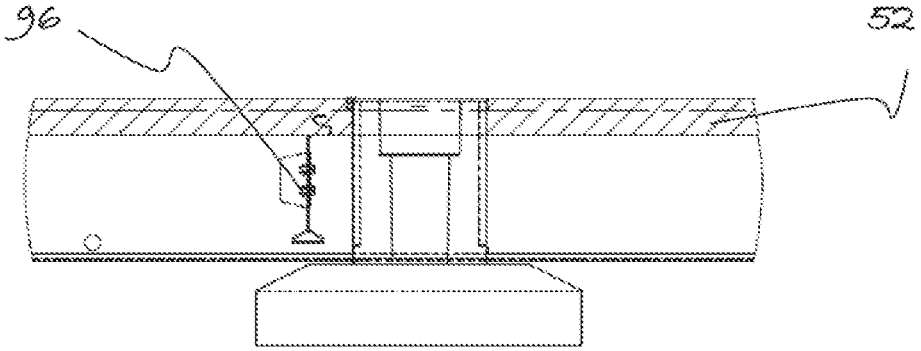
FIG. 24 is a schematic view of the detail J shown in FIG. 22.

In particular, as shown in FIGS. 22 to 24, the panel 48 comprises a perimeter channel 94 that is punched at intervals along the length to form tabs 96 for connecting the joists 98. The tabs 96 are positioned to specific design using the engineering limits and programmed by the design software.

Special holes are punched into the perimeter channel of the panel 48 to accept lifting eyes 100 for attachment of lifting cords 102. The position of the special holes is calculated from design information entered into the roll formers software. The lifting eyes 100 are fixed in the concrete slab with re-enforcement means.

Moreover, support members 68 that traverse transversally the beams 46, permit fastening the sides of the panels 48 to the sides of the beams 46—see FIGS. 16 and 19 to 21. In the particular arrangement shown in FIGS. 5 and 6, for each beam 46 there is one support member 68*a* located adjacent each side of the section 56 and 58 of the support surface 44 and four pairs of support members 68*b* arranged in a spaced apart relationship with respect to each other extending from one side of the sections 56 and 58.

FIG. 6 shows a particular support portion 62 of section 54 denoted as detail H of the support surface 44. Each support portion 62 may one or more parking bays 18.

The support portion 62 comprises four beams 46*a* to 46*d* joined together by three panels 48*a* to 48*c*. In particular, there are two outer beams 46*a* and 46*b* and two center beams 46*b* and 46*c*. As shown in FIGS. 6 and 8, each beam 46 is attached to columns 28*a* and 28*b* via fastening means 32. FIGS. 8*a* and 8*b* show the fastening means 32.

Each beam 46 comprises an inner end 58 and an outer end 60. The outer ends 60 are attached to outer columns 28*a*; the inner ends 58 are attached to inner columns 28*b*.

As shown in FIG. 6, two columns 28*c* are attached to outer beams 46*a* and 46*d*. Each column 28*c* is spaced apart from the ends of the beams 46*a* and 46*d*. The columns 28*c* are attached to the beams 46 via fastening means 34 shown in FIGS. 7*a* to 7*c*.

Further, the support portion 62 comprises two bracing members 40 on of its corners; one bracing member 40 extends from the outer columns 28*a* to the inner column segments 28*c* and 28*d*; the other bracing member 40 extends from the outer column 28*a* to the neighboring column 28*a*.

Moreover, as mentioned before, FIG. 6 shows the particular support portion 62 denoted as detail H of the support surface 44. As can be appreciated from FIG. 5, the support surface 44 comprises a plurality of support portions 62.

In a particular arrangement, each support portion 62 may comprise one or more parking bays for parking of vehicles; in particular, the beams 46 and panels 48 shown in FIG. 6 are arranged to define a five meter parking bay allowing four cars to be parked in a 2.5 m bay either side of a 5.5 meters to 7.5 meters two-way laneway.

In accordance with different arrangements, the width of the panel 48 may vary depending on the particular use that is given to the panel 48 and to the building structure 10 comprising the panel.

Figure 16A:
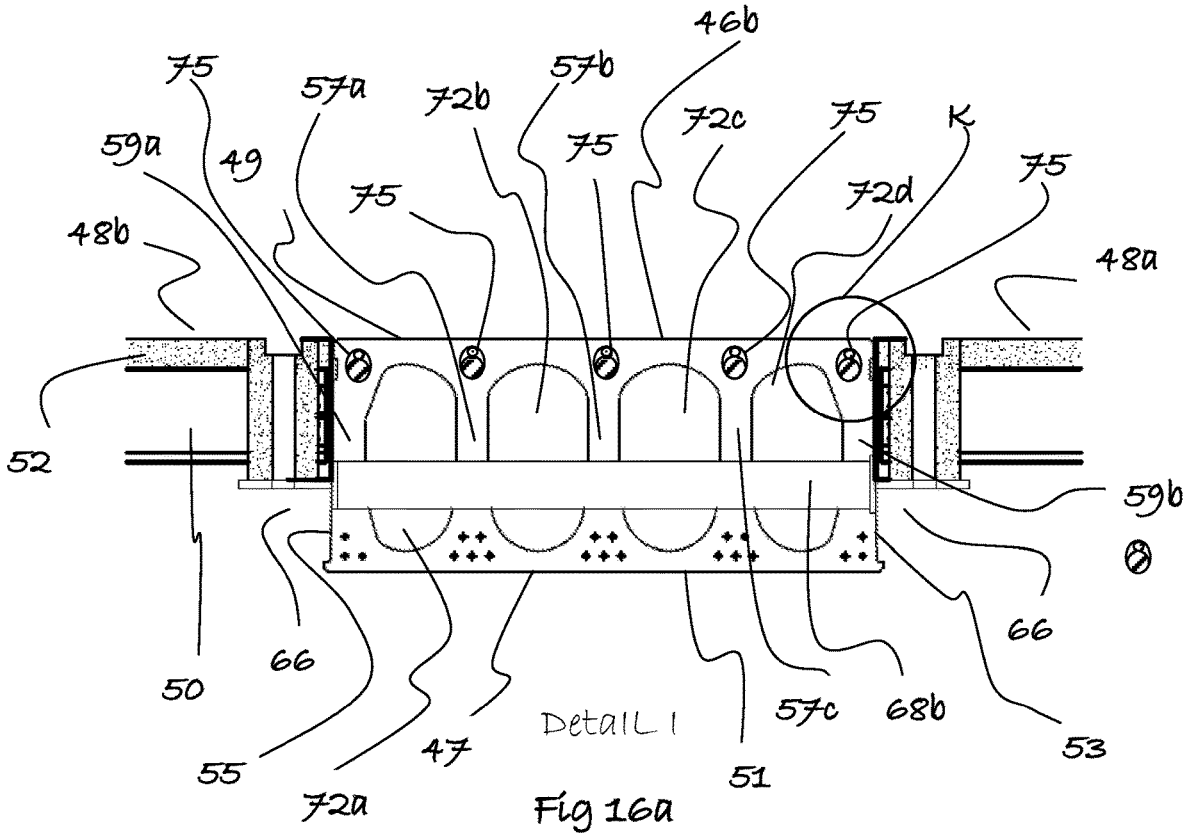
FIG. 16*a* is a schematic cross-sectional view of the detail I shown in FIG. 6.
Figure 16B:
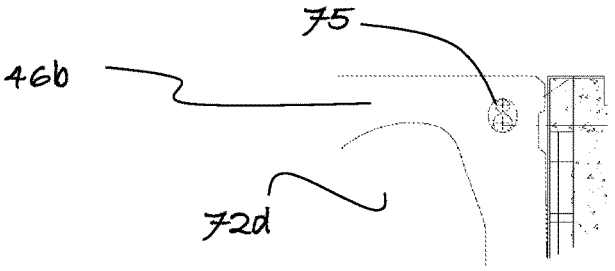
FIG. 16*b* is a schematic view of the detail K shown in FIG. 16*a;*
Figure 16C:
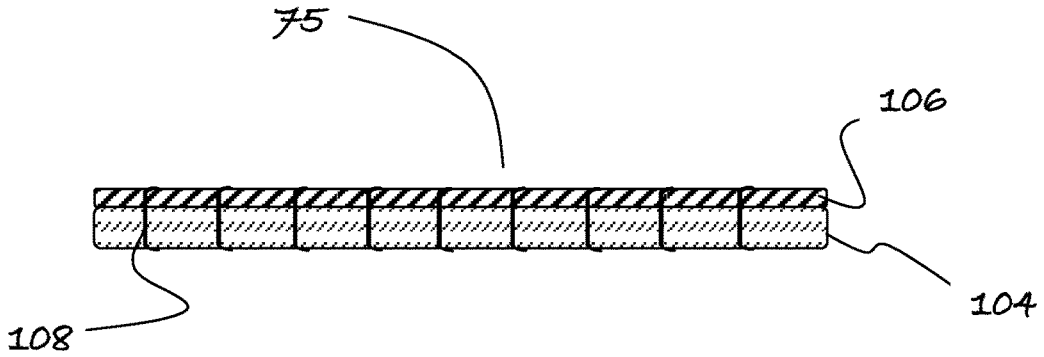
FIG. 16*c* is a schematic side view of a section of cable support in accordance with the present embodiment of the invention.
Figure 17:
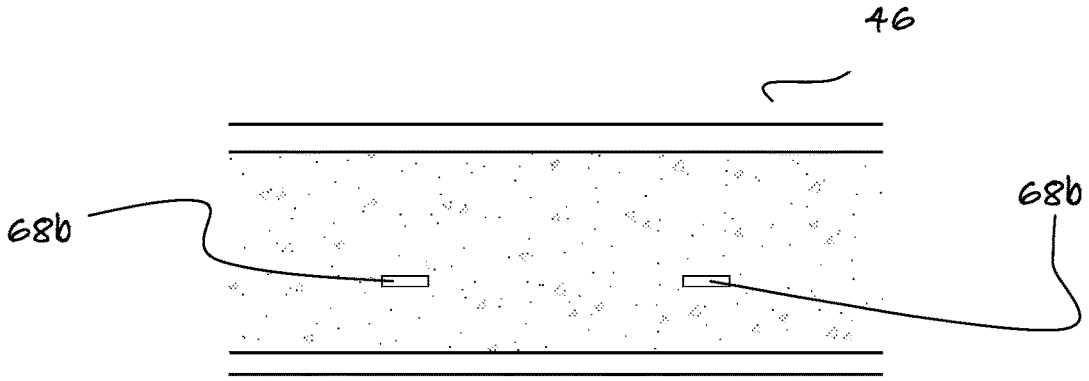
FIG. 17 is a schematic cross-sectional view of the detail C shown in FIG. 3.
Figure 18:
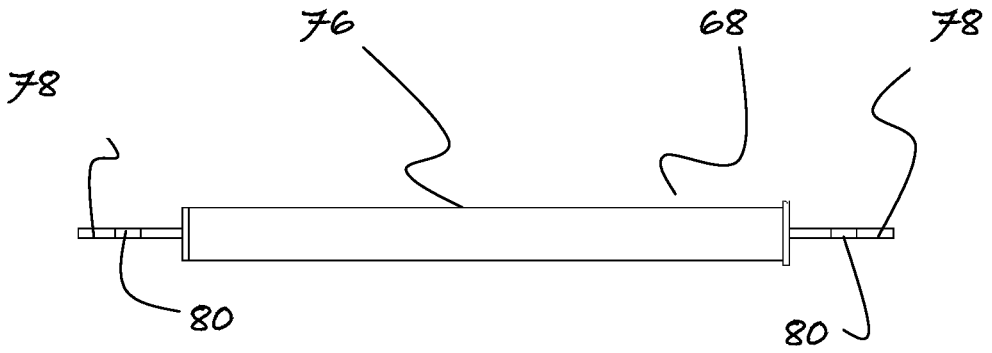
FIG. 18 is a schematic side view of a support member for fastening panels and beams together.

Referring now to FIGS. 16 to 18. FIGS. 16 to 18 show particular arrangements of beams 46.

Figure 20:
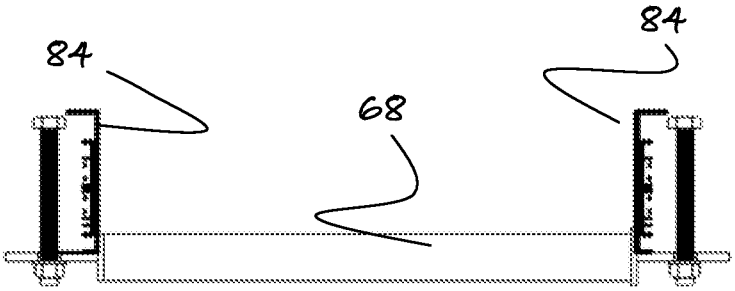
FIG. 20 is a schematic view of the support angles for fastening panels and beams together excluding the beam.

FIGS. 16 and 20 shows a first arrangement of the beam 46 in accordance with the present embodiment of the invention. The beam comprises a body 70 having a plurality of passages 72 arranged in a spaced apart relationship with respect to each other and extending longitudinally along the beam 46.

The beam 46 comprises a body 47 having upper and lower faces 49 and 51 and first and second sides 53 and 55. The upper and lower faces 49 and 51 are spaced apart from each other a particular distance defining the depth of the beam 46. A plurality of passages 72 extend longitudinally along the beam 46 and are arranged in a spaced apart relationship with respect to each other defining: (1) a web 57*a* between each pair of neighboring passages 72*a* and 72*b*; (2) a web 57*b* between each pair of neighboring passages 72*b* and 72*c*; and (3) a web 57*c* between each pair of neighboring passages 72*c* and 72*d*. And, two webs 59*a* and 59*b* are defined between the sides 53 and 55 of the beam 46 and the outer sides 73 of the passages 72*a* and 72*b*.

Further, the webs 57 have a width that is equal to the distance between neighboring passages measured at the thinnest section of the webs 57 and the webs 59 have a width that is equal to the distance, measured at the thinnest section, between the sides 53 and 55 of the beam 46 and the passages 72*a* and 72*b*.

In accordance with the present embodiment of the invention, the cumulative width (in order words, the summation of the width of the webs 57*a* to 57*c* and 59*a* and 59*b*) of the webs is greater or equal to the depth of the beam 46.

Referring now to FIG. 19 and FIGS. 16*a* to 16*c*.

Figure 19:
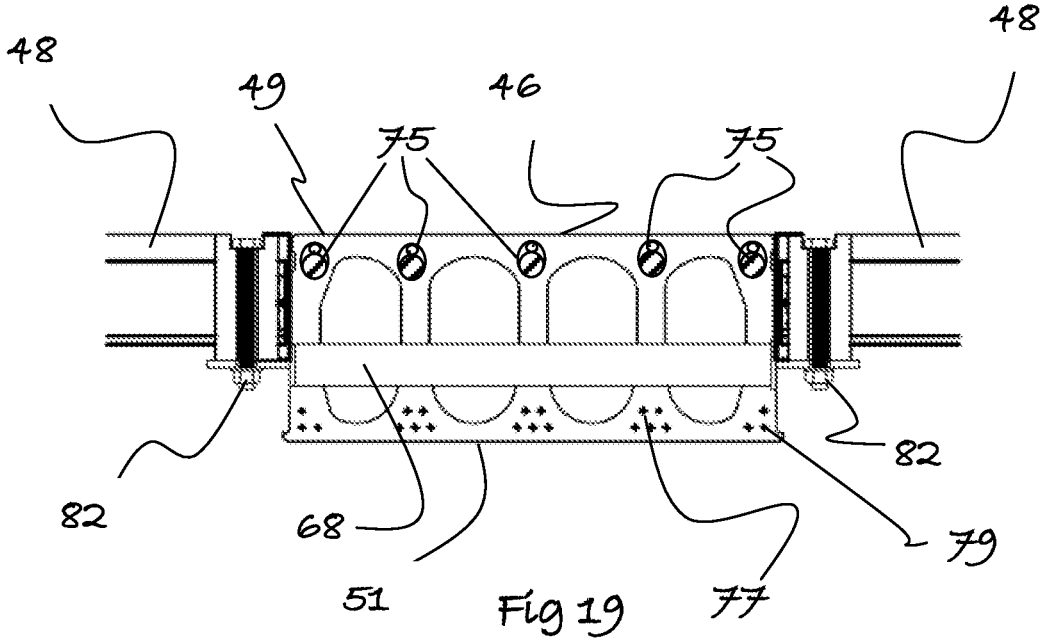
FIG. 19 is a schematic view of the detail I shown in FIG. 6 incorporating bolts or fastening panels and beams together.

As shown in FIG. 19, each beam 46 comprises a plurality of strands 74 as well as a plurality of support cables 75 arranged in a spaced apart relationship with respect to each other and extending longitudinally along the beam 46.

In particular, the beam 46 comprises a first group of support cables 75 adjacent the upper face 49 of the beam 46, a second group of sets of second strands 77 located adjacent the lower face 51 of the beam 46, and a third group of two sets of third strands 79, each set located at one lower corner of the beam 46.

The beam 46 comprises the five support cables 75 located at the upper face 49 of the beam 46 arranged in a spaced apart relationship with respect to each other and extending from one side 53 of the beam 46 to the other side 54 of the beam 46.

Referring now to FIG. 16*c*, each support cable 75 comprises a bar 104 and a wire 106 located side by side and joined together via a plurality of clips 108 arranged in a spaced apart relationship with respect to each other along the each support cable 75, each clip 108 surrounding a particular section of the each support cable 75. In a particular arrangement, neighboring clips 108 are spaced apart 100 mm with respect to each other.

In particular, the wire 106 and the bar 104 abut each other and are joined exclusively by the clips 108 that extend along the support cable. In this manner a compressive reinforcement is formed.

In a particular arrangement, the bar 104 comprises deformed reinforcing steel and the wire 106 comprises a strand.

Further, a second group of second strands 77 comprises three sets of second strands 77, each set of second strands 77 comprising five second strands 77 arranged in a trapezoidal array located at a lower section of the beam, and a third group of third strands 79 comprising two sets of three strands 79 arranged in an L-shaped array, each set of three strands 79 being located at one lower corner of the beam.

Preferably, each of the second and third strands 77 and 79 comprises a plurality of wires bundled together.

Further, each end of each beam 46 is sealed with a concrete plug that extends into passages 72.

Moreover, the beams 46 comprise support members 68 traversing transversally the beams 46. In particular, there are a plurality of support members 68 beams arranged in a spaced apart relationship with respect to each other, in a particular arrangement adjacent support members 68 are spaced apart up to three meters with respect to each other.

FIG. 18 shows a particular arrangement of the support member 68. The support beam 68 comprises a centre section 76 and two fin plates 78 extending from each end of the centre section 76. During use the support members 68 are installed into the beam 46 such that the center section 76 of the support member 68 is contained within the beam 46 and the fin plate 78 of the support beam 68 extend outward from each side of the beam 68. Each fin plate 78 comprises an opening 80 defining support angles 66 for attaching the beam 46 and panels 48 together.

Figure 21:
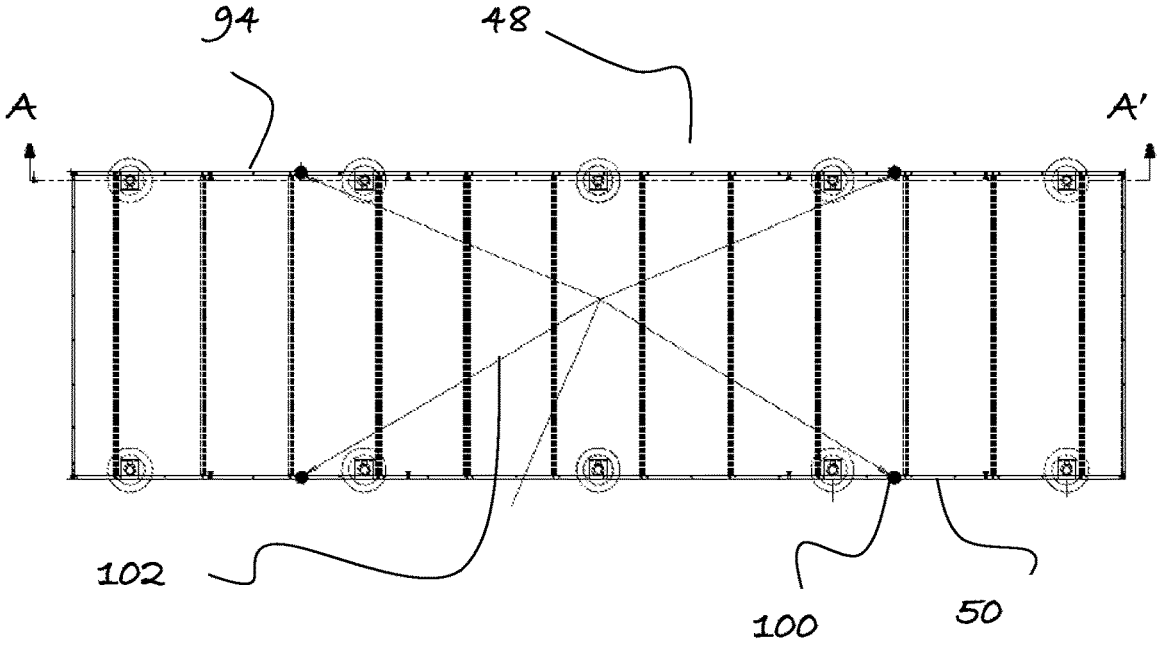
FIG. 21 is a schematic plan view of a floor panel of the building structure in accordance with the present embodiment of the invention.

As will be described with the method of assembly of the building structure 10, the sides of the panel 48 when abutting the sides of the panels 46 rest on the fin plates 78 permitting the panels 48 and the beam 46 to be bolted together via a bolt 82 traversing the sides of panels 48 and the fin plates 78—see FIG. 21.

The sides of the beams 46 are configured for receiving attachment means such as a bracket 84 of support angle 66. A shown in FIG. 19, a bracket 84 of support angle 66 may be attached to each side of the beam 46 for receiving the sides of the panels 46. This can be seen in FIGS. 20 and 21.

Moreover, a particular arrangement of a beam 46 spans a minimum of 22 meters, is 1200 millimeters wide and a minimum of 500 mm deep, and being able to carry a load of 12 tones. Each beam may hold four vehicles in static load and two moving vehicles.

Further, the beams 46 comprise pre-stressed strands 74 with height strength concrete. The beams are poured in 150 meter lengths and cured on heat beds. After heat curing the beams are cut to desired length for delivery to site.

In a particular arrangement, assembly of the building structure 10 comprises the steps of:

a. Excavation of footing and services including electrical and fire services.
b. Setting up steel fixing and pouring of concrete footings.
c. Transportation to site of columns 28 and installation thereof.
d. Transportation to site of beams 46 and panels 48 and lifting thereof and attachment to each other and to columns 28.
e. In a particular arrangement, every fourth beam is braced with 3 meters bracing 40.
f. Installation of ramps together with the car deck.
g. Installation of pavers on ground floor and stairs and lifts (if applicable).
h. Installation of services and parking payment installations.

The previously described arrangement of floor structure of the particular embodiment of the invention is particularly useful because it permits defining a building structure capable of carrying relative large loads (such as a multitude of vehicles) using lightweight floor panels facilitating assembly and disassembly of the building structure; this is possible due to the incorporation in the floor structures of one or more structural beams such as the structural beams in accordance with the present embodiment of the invention.

The reason that lightweight floor panels—instead of relative heavy structural floor panels—may be used is because of the incorporation of one or more structural beams in accordance with the present embodiment of the invention in the floor structure. This is in sharp contrast with the conventional building structures used, for example, as parking facilities capable of sustaining relative large loads; in these conventional parking facilities, the floor structure is defined, by, for example, floor panels consisting of a plurality of hollow core planks joined together to create a slab structure. In the prior art, the hollow core planks are not designed for sustaining large loads and therefore, a concrete topping is poured on the hollow core planks creating a composite structure that cannot be reused or adapted without demolition.

Modifications and variations as would be apparent to a skilled addressee are deemed to be within the scope of the present invention.

Further, it should be appreciated that the scope of the invention is not limited to the scope of the embodiments disclosed. By way of example, the present embodiment relates to a building structure 10 configured for use as a parking facility; however, in accordance with other embodiments of the present invention the building structure 10 may configured for use as residential, commercial and industrial building structures 10.

Throughout this specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A prestressed structural beam for defining a floor structure, the beam comprising a body having upper and lower faces and first and second sides, the upper and lower faces being spaced apart from each other a particular distance defining the depth of the beam, and a plurality of voided passages extending longitudinally along the beam, the plurality of voided passages being arranged in a spaced apart relationship with respect to each other, wherein the beam further comprises a plurality of support members being arranged in a spaced apart relationship with respect to each other along the length of the beam, the support members comprising a center section and two fin plates extending from each end of the center section, wherein the support members traverse transversally the beam for containment of the support members within the beam such that the center section of the support member is contained within the beam and the fin plates extend outward from each side of the beam.

2. The beam according to claim 1 wherein the plurality of voided passages defining a plurality of first webs between neighboring passages and a pair of second webs between the first and second sides of the beam and the outermost passages, the first web having a width that is equal to the distance between neighboring passages and the second webs having a width that is equal to the distance between the first and second sides of the beam and the outermost passages, wherein the summation of the widths of the first webs and the second webs is greater or equal to the depth of the beam.

3. The beam according to claim 1 wherein a plurality of group of strands are arranged in a spaced apart relationship with respect to each other and extending longitudinally along the beam.

4. The beam according to claim 1, comprising a first group of support cables adjacent the upper face of the beam, a second group of sets of second strands located adjacent the lower face of the beam, and a third group of two pairs of third strands, each pair located at one lower corner of the beam.

5. The beam according to claim 4 wherein the beam comprises five support cables located at an upper section of the beam arranged in a spaced apart relationship with respect to each other and extending from one side of the beam to the other side of the beam.

6. The beam according to claim 4 or 5 wherein a second group of second strands comprises three sets of second strands, each set of second strands comprising five second strands arranged in a trapezoidal array located at a lower section of the beam, and a third group of third strands comprising two sets of three strands arranged in an L-shaped array, each set of three strands being located at one lower corner of the beam.

7. The beam according to claim 5 wherein each support cable comprises a bar and a wire located side by side and joined together via a plurality of clips arranged in a spaced apart relationship with respect to each other along the length of the first strand, each clip surrounding a particular section of the each first strand.

8. The beam according to claim 7 wherein the bar and the wire abut each other and are joined together exclusively by the clips.

9. The beam according to claim 8 wherein the wire comprises a strand.

10. The beam according to claim 7 wherein the bar comprises deformed reinforcing steel.

11. The beam according to claim 7 wherein each of the second and third strands comprises a plurality of wires bundled together.

12. The beam according to claim 1 wherein the support members are spaced apart up to three meters with respect to each other.

13. The beam according to claim 1 wherein the fin plates of each support member extend from the sides of the beams are adapted to receive sides of floor panels to be attached to the sides of the beam.

14. The beam according to claim 1 wherein each side of the beam comprises a plurality of support angles arranged in a spaced apart relationship with respect to each other along the beam, the support angle defining attachment means for attaching the sides of the floor panel to the sides of the beam.

15. The beam according to claim 1 wherein ends of the beam comprise a concrete plug extending at least partially into the passages for sealing off the passages.

16. A prestressed structural beam for defining a floor structure, the beam comprising a body having upper and lower faces and first and second sides, the upper and lower faces being spaced apart from each other a particular distance defining the depth of the beam, and a plurality of voided passages extending longitudinally along the beam, the plurality of voided passages being arranged in a spaced apart relationship with respect to each other defining a plurality of first webs between neighboring passages and a pair of second webs between the first and second sides of the beam and the outermost passages, the beam further comprises a first group of support cables adjacent the upper face of the beam, a second group of sets of second strands located adjacent the lower face of the beam, and a third group of two pairs of third strands, each pair located at one lower corner of the beam, wherein the support cables comprise a bar and a wire, the bar and the wire located side by side and joined exclusively together via a plurality of clips arranged in a spaced apart relationship with respect to each other along the support cables, each clip surrounding a particular section of the support cables, wherein the bar and the wire continuously abut each other as the wire extends along the length of the bar to define the support cables.

17. The beam according to claim 16 wherein the beam comprises five support cables located at an upper section of the beam arranged in a spaced apart relationship with respect to each other and extending side by side from one side of the beam to the other side of the beam.

18. The beam according to any one of claims 16 and 17 wherein a second group of second strands comprises three sets of second strands, each set of second strands comprising five second strands arranged in a trapezoidal array located at a lower section of the beam, and a third group of third strands comprising two sets of three strands arranged in an L-shaped array, each set of three strands being located at one lower corner of the beam.

19. A floor structure comprising first and second structural beams and one first infill panel wherein the first and second beams are arranged in a spaced apart relationship with respect to each other defining a spacing for receiving the infill panel, wherein each of the first and second structural beams comprises either: (1) a body having upper and lower faces and first and second sides, the upper and lower faces being spaced apart from each other a particular distance defining the depth of the beam, and a first plurality of voided passages extending longitudinally along the beam, the first plurality of voided passages being arranged in a spaced apart relationship with respect to each other, wherein the beam further comprises a plurality of support members being arranged in a spaced apart relationship with respect to each other along the length of the beam, the support members comprising a center section and two fin plates extending from each end of the center section, wherein the support members traverse transversally the beam for containment of the support members within the beam such that the center section of the support member is contained within the beam and the fin plates extend outward from each side of the beam; or (2) a body having upper and lower faces and first and second sides, the upper and lower faces being spaced apart from each other a particular distance defining the depth of the beam, and a second plurality of voided passages extending longitudinally along the beam, the second plurality of voided passages being arranged in a spaced apart relationship with respect to each other defining a plurality of first webs between neighboring passages and a pair of second webs between the first and second sides of the beam and the outermost passages, the beam further comprises a first group of support cables adjacent the upper face of the beam, a second group of sets of second strands located adjacent the lower face of the beam, and a third group of two pairs of third strands, each pair located at one lower corner of the beam, wherein the support cables comprise support cables comprising a bar and a wire, the bar and the wire located side by side and joined exclusively together via a plurality of clips arranged in a spaced apart relationship with respect to each other along the support cable, each clip surrounding a particular section of the support cable, wherein the bar and the wire continuously abut each other as the wire extends along the length of the bar to define the support cable.

20. The floor structure according to claim 19 wherein the infill panel comprises a lightweight panel comprising lightweight joist with raised floor systems.

21. The floor structure according to any one of claims 19 and 20 wherein the infill panel comprises a mesh structure encased in a concrete slab.

22. The floor structure according to claim 19 wherein the infill panel comprises a perimeter channel that is punched at intervals along the length to form tabs for connecting joists extending transversally from one side of the panel to the other side of the panel and arranged in a spaced apart relationship with respect to each other extending longitudinally along the panel.

23. The floor structure according to claim 22 wherein the perimeter channel comprises lifting eyes arranged in a spaced apart relationship with respect to each other.

24. The floor structure according to claim 22 wherein the perimeter channel is adapted for attachment to the inner sides of the beams.

25. The floor structure according to claim 19 wherein the floor structure further comprises a third beam and a second infill panel, the third beam being arranged in spaced apart arrangement with the first beam defining a spacing for receiving the second infill panel, the third beam comprising an inner side adapted for attachment of one side of the second infill panel and another side of the second infill panel being adapted for attachment to the outer side of the first beam.

26. The floor structure according to claim 19 wherein the floor structure further comprises a fourth beam and a third infill panel, the fourth beam being arranged in spaced apart arrangement with the second panel defining a spacing for receiving the third infill panel, the fourth beam comprising an inner side adapted for attachment of a side of the third infill panel and the other side of the third infill panel being adapted for attachment to the outer side of the second beam.

27. A building structure comprising a plurality of columns arranged in a spaced apart relationship with respect to each other, and at least one floor structure as defined in claim 19 spaced apart from the ground and attached to the columns at a particular location along the columns.

28. The building structure according to claim 27 wherein the building structure comprises a plurality of reinforcement beams extending between the columns.

29. The building structure according to claim 27 or 28 wherein the building structure comprises cross bracing members extending between the columns.

30. The building structure according to claim 27 wherein the building structure comprises outer and inner columns.

31. The building structure according to claim 30 wherein the inner columns are spaced apart from the outer columns and bracing member extend between the inner and outer columns.

32. The building structure according to claim 30 or 31 wherein there are a plurality of floor structures attached to the outer columns and arranged in a spaced apart relationship with respect to each other along the columns.

33. The building structure according to claim 30 wherein the inner columns comprise a plurality of column segments extending between floor structures, ends of each column segment being attached to the floor structures between which the column segment is sandwiched.

34. The building structure according to claim 33 wherein the column segments are spaced apart from the outer columns and bracing members extend between the outer columns and the column segments.

35. The building structure according to claim 34 wherein, the inner columns are spaced apart with respect to each other in such a manner that each pairs of bracing members joining together the outer columns and the column segments of the inner column of a particular floor structure define a portion comprising at least one parking bay.

36. The building structure according to claim 27 wherein the building structure comprises guardrails extending between the columns.

37. The building structure according to claim 27 wherein the building structure comprises a main area and an access area, the access area comprises staircases and ramps allowing the vehicles and pedestrians access to the main area of the building structure, wherein the ramps comprise at least one beam, wherein the at least one beam comprises either: (1) a prestressed structural beam for defining a floor structure, the beam comprising a body having upper and lower faces and first and second sides, the upper and lower faces being spaced apart from each other a particular distance defining the depth of the beam, and a first plurality of voided passages extending longitudinally along the beam, the first plurality of voided passages being arranged in a spaced apart relationship with respect to each other, wherein the beam further comprises a plurality of support members being arranged in a spaced apart relationship with respect to each other along the length of the beam, the support members comprising a center section and two fin plates extending from each end of the center section, wherein the support members traverse transversally the beam for containment of the support members within the beam such that the center section of the support member is contained within the beam and the fin plates extend outward from each side of the beam, or (2) a body having upper and lower faces and first and second sides, the upper and lower faces being spaced apart from each other a particular distance defining the depth of the beam, and a second plurality of voided passages extending longitudinally along the beam, the second plurality of voided passages being arranged in a spaced apart relationship with respect to each other defining a plurality of first webs between neighboring passages and a pair of second webs between the first and second sides of the beam and the outermost passages, the beam further comprises a first group of support cables adjacent the upper face of the beam, a second group of sets of second strands located adjacent the lower face of the beam, and a third group of two pairs of third strands, each pair located at one lower corner of the beam, wherein the support cables comprise support cables comprising a bar and a wire, the bar and the wire located side by side and joined exclusively together via a plurality of clips arranged in a spaced apart relationship with respect to each other along the support cable, each clip surrounding a particular section of the support cable, wherein the bar and the wire continuously abut each other as the wire extends along the length of the bar to define the support cable.

38. A method for erecting the building structure of claim 27, wherein the method comprises the step of:

excavation of footing and services including electrical and fire services;

setting up steel fixing and pouring of concrete footings;

transportation to site of columns and installation thereof;

transportation to site of either 1) beams for defining a floor structure, each beam comprising a body having upper and lower faces and first and second sides, the upper and lower faces being spaced apart from each other a particular distance defining the depth of the beam, and a plurality of voided passages extending longitudinally along the beam, the plurality of voided passages being arranged in a spaced apart relationship with respect to each other, wherein the beam further comprises a plurality of support members being arranged in a spaced apart relationship with respect to each other along the length of the beam, the support members comprising a center section and two fin plates extending from each end of the center section, wherein the support members traverse transversally the beam for containment of the support members within the beam such that the center section of the support member is contained within the beam and the fin plates extend outward from each side of the beam or 2) a prestressed structural beam for defining a floor structure, the prestressed structural beam comprising a body having upper and lower faces and first and second sides, the upper and lower faces being spaced apart from each other a particular distance defining the depth of the prestressed structural beam, and a plurality of voided passages extending longitudinally along the prestressed structural beam, the plurality of voided passages being arranged in a spaced apart relationship with respect to each other defining a plurality of first webs between neighboring passages and a pair of second webs between the first and second sides of the beam and the outermost passages, the beam further comprises a first group of support cables adjacent the upper face of the prestressed structural beam, a second group of sets of second strands located adjacent the lower face of the prestressed structural beam, and a third group of two pairs of third strands, each pair located at one lower corner of the prestressed structural beam, wherein the support cables comprise support cables and panels to define the floor structure, wherein the support cables comprise a bar and a wire, the bar and the wire located side by side and joined exclusively together via a plurality of clips arranged in a spaced apart relationship with respect to each other along the support cables, each clip surrounding a particular section of the support cables, wherein the bar and the wire continuously abut each other as the wire extends along the length of the bar to define the support cables, and wherein the floor structure comprises: first and second structural beams and one first infill panel wherein the first and second beams are arranged in a spaced apart relationship with respect to each other defining a spacing for receiving the infill panel, wherein each of the first and second structural beams comprises either: (1) a body having upper and lower faces and first and second sides, the upper and lower faces being spaced apart from each other a particular distance defining the depth of the beam, and a first plurality of voided passages extending longitudinally along the beam, the first plurality of voided passages being arranged in a spaced apart relationship with respect to each other, wherein the beam further comprises a plurality of support members being arranged in a spaced apart relationship with respect to each other along the length of the beam, the support members comprising a center section and two fin plates extending from each end of the center section, wherein the support members traverse transversally the beam for containment of the support members within the beam such that the center section of the support member is contained within the beam and the fin plates extend outward from each side of the beam; or (2) a body having upper and lower faces and first and second sides, the upper and lower faces being spaced apart from each other a particular distance defining the depth of the beam, and a second plurality of voided passages extending longitudinally along the beam, the second plurality of voided passages being arranged in a spaced apart relationship with respect to each other defining a plurality of first webs between neighboring passages and a pair of second webs between the first and second sides of the beam and the outermost passages, the beam further comprises a first group of support cables adjacent the upper face of the beam, a second group of sets of second strands located adjacent the lower face of the beam, and a third group of two pairs of third strands, each pair located at one lower corner of the beam, wherein the support cables comprise support cables comprising a bar and a wire, the bar and the wire located side by side and joined exclusively together via a plurality of clips arranged in a spaced apart relationship with respect to each other along the support cable, each clip surrounding a particular section of the support cable, wherein the bar and the wire continuously abut each other as the wire extends along the length of the bar to define the support cable and lifting thereof and attachment to each other and to the erected columns;

bracing each floor structure with bracing members;

installation of ramps together with the car deck;

installation of pavers on ground floor and stairs and lifts; and installation of services and parking payment installations.

* * * * *